US007731119B2

(12) United States Patent
Heaney et al.

(10) Patent No.: US 7,731,119 B2
(45) Date of Patent: Jun. 8, 2010

(54) COMPACT SINGLE MANDREL CREEL FOR OVER END TAKE-OFF THREAD DELIVERY

(75) Inventors: Daniel J. Heaney, Neenah, WI (US); Dennis Hicks, Neenah, WI (US); Jon P. Graverson, Neenah, WI (US); Jeff Shackleton, Neenah, WI (US); Paul De Moel, Waspik (NL)

(73) Assignee: INVISTA North America S.á rL., Wilmington, DE (US)

( * ) Notice: Subject to any disclaimer, the term of this patent is extended or adjusted under 35 U.S.C. 154(b) by 270 days.

(21) Appl. No.: 11/546,185

(22) Filed: Oct. 11, 2006

(65) Prior Publication Data

US 2007/0084960 A1 Apr. 19, 2007

Related U.S. Application Data

(60) Provisional application No. 60/724,796, filed on Oct. 11, 2005.

(51) Int. Cl.
*B65H 67/00* (2006.01)

(52) U.S. Cl. ..... 242/560.2; 242/551; 242/131

(58) Field of Classification Search ..... 242/551, 242/558, 559, 560, 560.2, 131, 131.1, 473.4, 242/473.5, 555, 555.1, 555.2, 555.3
See application file for complete search history.

(56) References Cited

U.S. PATENT DOCUMENTS

| | | | |
|---|---|---|---|
| 3,236,265 | A | 2/1966 | Brookshire |
| 3,693,904 | A | 9/1972 | Bucher |
| 4,358,068 | A | 11/1982 | Weiss |
| 4,450,876 | A | 5/1984 | van Mullekom |
| 4,545,547 | A | 10/1985 | Singer |
| 4,648,564 | A | 3/1987 | Wright, Jr. |
| 5,566,574 | A | 10/1996 | Tiziano |
| 5,613,643 | A | 3/1997 | Weiner |
| 6,634,585 | B1 | 10/2003 | Ingram, III |

FOREIGN PATENT DOCUMENTS

| | | | |
|---|---|---|---|
| EP | 619261 | A1 * | 10/1994 |
| GB | 303475 | A * | 3/1929 |

* cited by examiner

*Primary Examiner*—John Q Nguyen
*Assistant Examiner*—William E Dondero
(74) *Attorney, Agent, or Firm*—Christina W. Geerlof

(57) ABSTRACT

The present invention compact creel using the OETO method that accommodates an increased number of packages in a relatively small footprint while providing a straight in-line delivery path in which fiber bends and changes in direction are minimized. In addition, the present invention is a system, apparatus and method for tension control in a fiber feeding system that provides a fast and reliable method for feeding high tack elastomeric thread or fiber from a package to a manufacturing process. Furthermore, the present invention provides a method and apparatus for changing packages on a creel without interrupting the manufacturing process. In particular, the compact creel of the present invention provides for continuous operation of unwinding and fiber delivery by allowing a standby package to be loaded on the same mandrel as an active package that is presently being unwound.

3 Claims, 17 Drawing Sheets

1

3
4
7
5
9
6
8
17
13
9
5
6

3
6
5
9
12
4
5
11
22
7
10

1
3

13
6
7
5
21
8
19

3
21
28
30
24
28
4
5
6
23
26
22

3
5
6
7
8
13
19
21

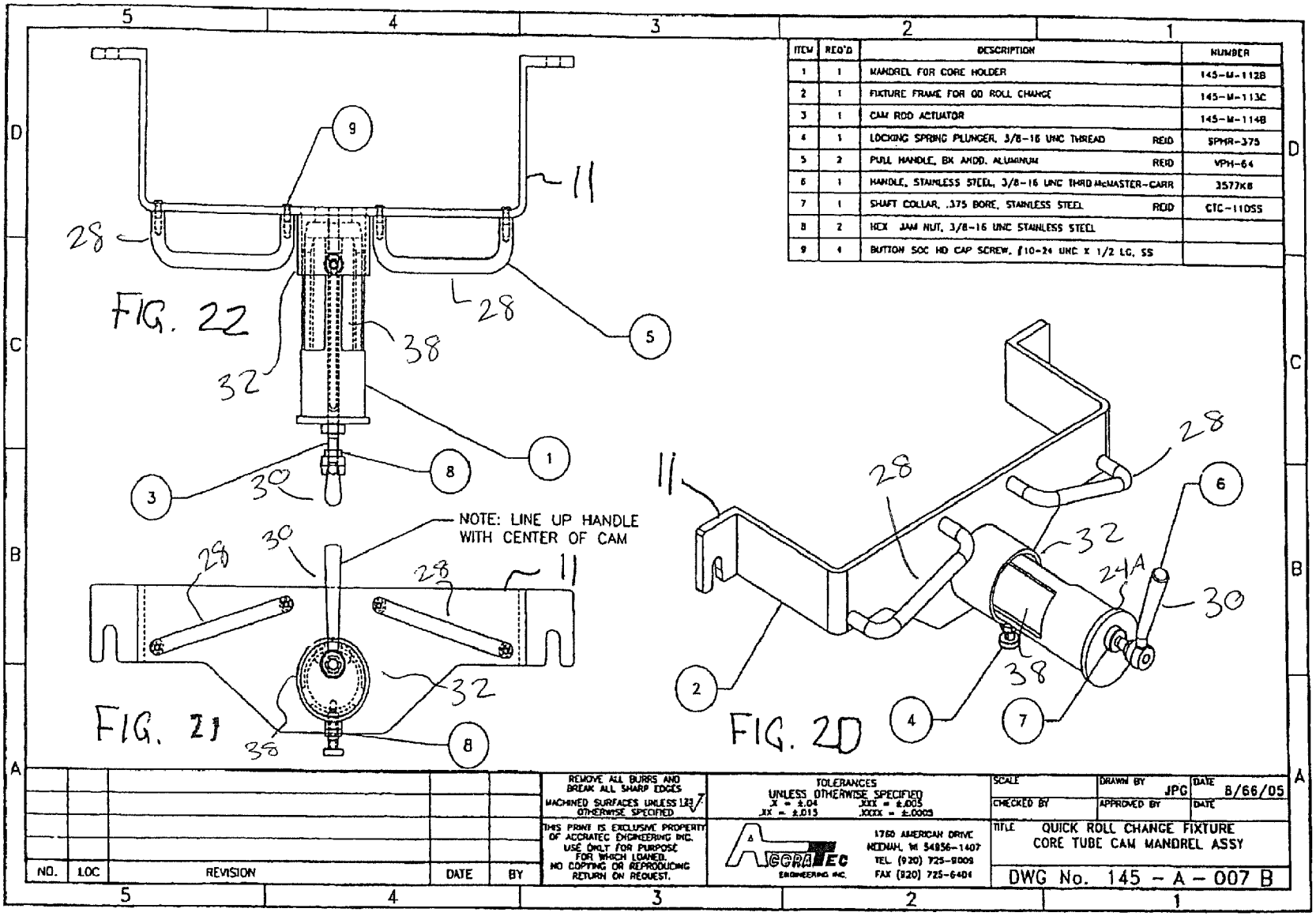
ITEM | REQ'D | DESCRIPTION | NUMBER
1 | 1 | MANDREL FOR CORE HOLDER | 145-M-112B
2 | 1 | FIXTURE FRAME FOR QD ROLL CHANGE | 145-M-113C
3 | 1 | CAM ROD ACTUATOR | 145-M-114B
4 | 1 | LOCKING SPRING PLUNGER, 3/8-16 UNC THREAD REQD | SPHR-375
5 | 2 | PULL HANDLE, BK ANOD. ALUMINUM REQD | VPH-64
6 | 1 | HANDLE, STAINLESS STEEL, 3/8-16 UNC THRD MASTER-CARR | 3577K8
7 | 1 | SHAFT COLLAR, .375 BORE, STAINLESS STEEL REQD | CTC-110SS
8 | 2 | HEX JAM NUT, 3/8-16 UNC STAINLESS STEEL
9 | 4 | BUTTON SOC HD CAP SCREW, #10-24 UNC X 1/2 LG. SS
NOTE: LINE UP HANDLE WITH CENTER OF CAM
FIG. 2D
FIG. 22
FIG. 21
TOLERANCES UNLESS OTHERWISE SPECIFIED
REMOVE ALL BURRS AND BREAK ALL SHARP EDGES
MACHINED SURFACES UNLESS OTHERWISE SPECIFIED
THIS FORM IS EXCLUSIVE PROPERTY OF ACCURATEC ENGINEERING INC.
NO COPYING OR REPRODUCING RETURN ON REQUEST.
1760 AMERICAN DRIVE
MEDIAN, WI 54136-1407
TEL (920) 723-2508
FAX (920) 723-6401
SCALE
CHECKED BY
DRAWN BY JPC
DATE 8/06/05
APPROVED BY
DATE
TITLE QUICK ROLL CHANGE FIXTURE
CORE TUBE CAM MANDREL ASSY
DWG No. 145 - A - 007 B
NO. LOC REVISION DATE BY

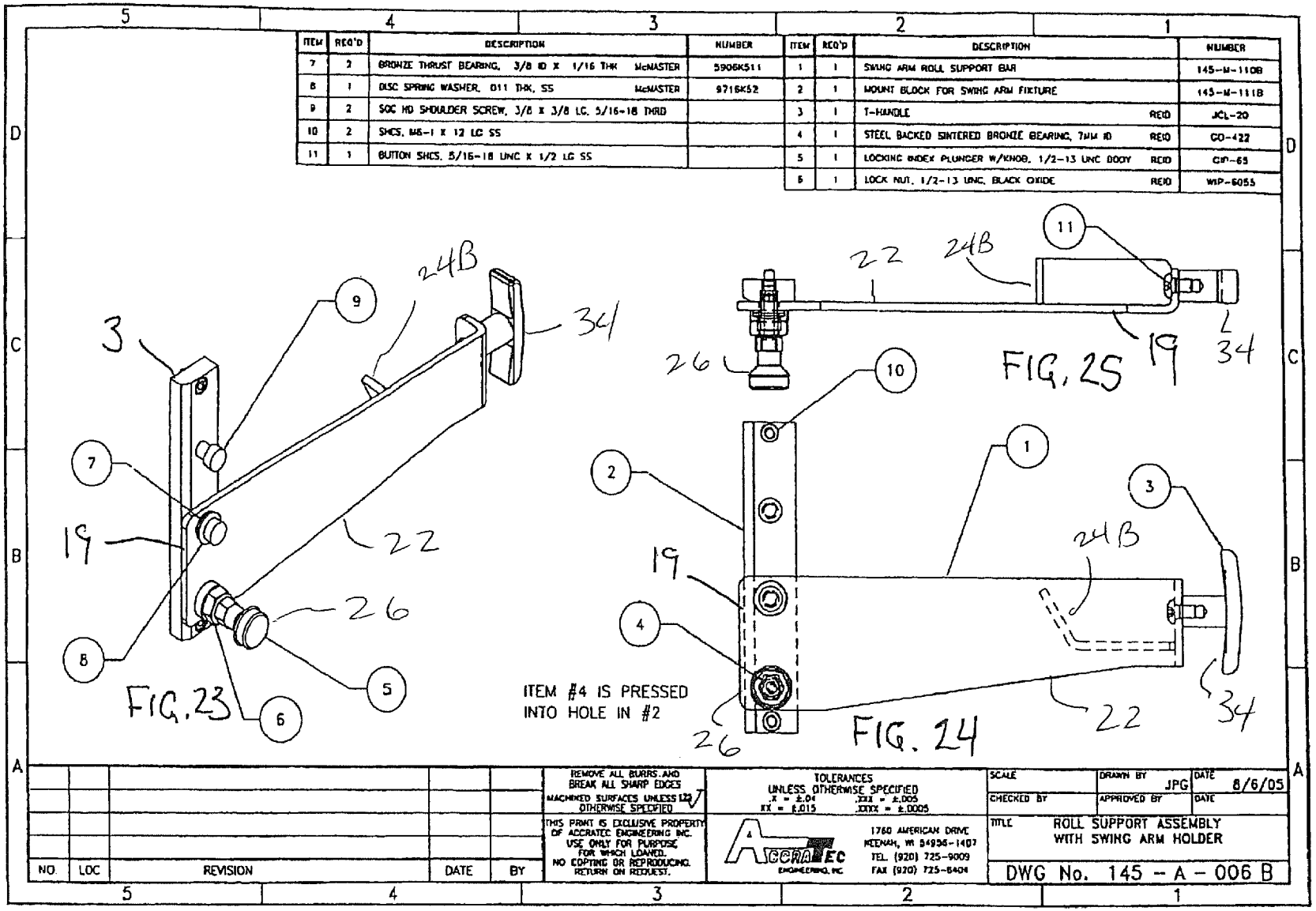
ITEM REQ'D DESCRIPTION NUMBER
7 2 BRONZE THRUST BEARING, 3/8 ID X 1/16 THK McMASTER 5906K511
8 1 DISC SPRING WASHER, .011 THK, SS McMASTER 9716K42
9 2 SOC HD SHOULDER SCREW, 3/8 X 3/8 LG, 5/16-18 THRD
10 2 SHCS, M6-1 X 12 LG SS
11 1 BUTTON SHCS, 5/16-18 UNC X 1/2 LG SS
ITEM REQ'D DESCRIPTION NUMBER
1 1 SWING ARM ROLL SUPPORT BAR 145-M-1108
2 1 MOUNT BLOCK FOR SWING ARM FIXTURE 145-M-1118
3 1 T-HANDLE JCL-20
4 1 STEEL BACKED SINTERED BRONZE BEARING, THM #0 REQD CD-422
5 1 LOCKING INDEX PLUNGER W/KNOB, 1/2-13 UNC BODY REQD CIP-63
6 1 LOCK NUT, 1/2-13 UNC, BLACK OXIDE REQD WNP-8055
FIG. 25
FIG. 24
FIG. 23
ITEM #4 IS PRESSED INTO HOLE IN #2
REMOVE ALL BURRS AND BREAK ALL SHARP EDGES
MACHINED SURFACES UNLESS OTHERWISE SPECIFIED
TOLERANCES UNLESS OTHERWISE SPECIFIED
.XX = ±.01 .XXX = ±.005
.XX = ±.015 .XXX = ±.0005
ACCUTEC ENGINEERING INC
1760 AMERICAN DRIVE
NEENAH, WI 54956-1107
TEL (920) 725-9009
FAX (920) 725-8404
THIS PRINT IS EXCLUSIVE PROPERTY OF ACCUTEC ENGINEERING INC. USE ONLY FOR INTENDED PURPOSE. NO COPYING OR REPRODUCING. RETURN ON REQUEST.
NO LOC REVISION DATE BY
SCALE
CHECKED BY
DRAWN BY JPG DATE 8/6/05
APPROVED BY DATE
TITLE ROLL SUPPORT ASSEMBLY WITH SWING ARM HOLDER
DWG No. 145 - A - 006 B NOTE: ITEM 1 SUPPLIED BY ACCRATEC, VENDOR TO INSTALL.
ALL FASTENERS ARE STAINLESS STEEL DRIVE ASSY, RF/TOOKRY
WITH TSA TENSION SENSOR
DWG No. 142 - A - 226 C

COMPACT SINGLE MANDREL CREEL FOR OVER END TAKE-OFF THREAD DELIVERY

CROSS-REFERENCE TO RELATED APPLICATION

This application claims benefit of priority from Provisional Application No. 60/724,796 filed Oct. 11, 2005.

BACKGROUND OF THE INVENTION

1. Field of the Invention

The present invention relates to a thread delivery system or fiber unwinding device, and more specifically to a compact creel system or device for continuous delivery of threads or fibers to a downstream fiber manufacturing process or device.

2. Description of Background Art

Creels are well known in the background art and support packages upon which thread, fiber or yarn is wound for delivery to an associated manufacturing device such as a loom or a diaper machine (note: the terms "thread," "fiber" and "yarn" are used interchangeably throughout this document). The most common method of unwinding yarn from a cylindrical mandrel (i.e., a "package") on a creel in manufacturing processes is referred to as "rolling take-off" (RTO) method. In the RTO method, when an active package is exhausted the empty cylindrical mandrel must be removed and a new or standby package is installed. The step of removing the empty mandrel in the RTO method typically requires shutting down the manufacturing process. This shut down of the manufacturing process in the problem of unproductive downtime on a manufacturing line using the RTO method.

In contrast to the RTO method discussed above, an over end take-off (OETO) method allows continuous operation of a manufacturing process. In the OETO method, the terminating end of the fiber wound on the active package is attached to the leading end of the fiber wound on the standby package. Once the active package is completely exhausted, the standby package becomes the new active package without any interruption in the manufacturing process. In this manner, a rather continuous feed of fiber to the manufacturing process is provided.

Background art creels have been provided with various horizontal and vertical arrangements of packages to take advantage of the OETO method. For example, U.S. Pat. Nos. 3,693,904 and 4,450,876 disclose horizontal arrangements of yarn packages configured in pairs for supplying an associated manufacturing process. U.S. Pat. Nos. 3,236,265; 4,358,068; and 4,648,564 disclose vertical arrangements of yarn packages configured in pairs for feeding associated manufacturing process machinery such as looms or diaper machines.

However, with the advent of higher speed manufacturing processes, a configuration of two yarn packages tied together has become increasingly insufficient to supply the associated machinery, and creels with arrangements of four yarn packages tied together have been provided. For example, U.S. Pat. No. 4,545,547 discloses a creel commonly known as a "carousel creel" which includes four yarn packages are configured horizontally and tied together. Moreover, U.S. Pat. Nos. 5,613,643 and 6,634,585 disclose creels using a large number of packages to continuously feed a high speed manufacturing process. However, a problem with carousel and other creels that handle a large number of packages is that the fibers must undergo several changes in direction as it is fed from the packages to other associated machinery. Each time the fiber changes direction, particularly sharply, the chances of a fiber break are greatly increased because of the increased tension resulting from the changes in direction. Fiber breaks with such creels also cause interruptions in the manufacturing process and lead to the problem of unproductive downtime discussed above.

An additional problem with creels using multiple packages is related to the size of the yarn packages which can be provided and supported on a creel. That is, the amount of yarn is limited due to practicalities such as weight and space occupied by the package. For example, typical yarn packages of up to 12" in diameter are utilized to provide a large amount of yarn to a high speed manufacturing process such as a diaper machine. However, a large number of packages of this size package can take up a lot of valuable manufacturing floor space when used with creel configurations of the background art.

To handle the problem due to the size of the multiple packages needed, background art creels for the OETO method are typically configured with the active package and standby package positioned at acute angles (i.e., less than 90°) relative to one another. However, as noted above, a problem with OETO creels with this type of configuration is the valuable floor space they take up in the manufacturing environment. In addition, unacceptable variations in threadline tension are common with these background art creels when using the OETO method.

U.S. Pat. No. 5,566,574 discloses a method for feeding fiber to a textile machine by utilizing a braking member and actuator to adjust the tension and feed rate of the thread or fiber in an attempt to address the tension problems discussed above. However, the '574 patent does not disclose the concept of utilizing a variable speed electrical motor for a driven roll, where the speed of the motor is determined based on a range of desired thread tensions and could improve the performance of the manufacturing process.

Further, manufacturing processes using an elastomeric thread or fiber like Spandex, which has a unique inherent finish texture that differs from threads or fibers used in the textile industry, requires an electrical motor feeding device that allows the Spandex to remain in contact with the driven feed roll attached to the motor. Furthermore, Spandex has a higher tensile strength specification and other characteristics that differ from fibers used in the textile industry. For example, threads or fibers typically used in the textile industry are specified in the range of 50-100 decitex (decigrams per kilometer) and tend to operate at lower rotation speeds of 1-50 feet/minute when being unwound from a package as compared to those used for elastomeric threads which typically are specified in the range of 600-1500 decitex and with higher rotation speeds of 300-400 feet/minute. Moreover, the '574 patent is not directed to operate with or feed systems that require high tack, elastomeric threads such as Spandex.

The aforementioned problems make the continuous processing of high tack, elastomeric fibers particularly problematic. Fiber tack and its associated problems have been addressed by using topical fiber additives (e.g., prior to winding) or by unwinding the package and re-winding it on a new mandrel. However, both approaches add additional expense to the manufacturing process. Furthermore some applications (e.g., manufacturing of diapers and other personal care products) require the use of as-spun thread or fiber that is substantially finish-free and, consequently, exhibits high tack.

Therefore, there is a need in the art for creels that: (1) allow packages to be changed without interrupting the manufacturing process; (2) hold a large number of packages for feeding fiber to high speed manufacturing processes in a relatively compact footprint; (3) minimize the changes in direction of the fiber during delivery to eliminate breaks and minimize tension; (4) provide a fast, reliable and continuous method of unwinding, feeding and delivering high tack elastomeric fibers from a package to a high speed manufacturing process.

SUMMARY OF THE INVENTION

The present invention compact creel using the OETO method that accommodates an increased number of packages in a relatively small footprint while providing a straight in-line delivery path in which fiber bends and changes in direction are minimized. In addition, the present invention is a system, apparatus and method for tension control in a fiber feeding system that provides a fast and reliable method for feeding high tack elastomeric thread or fiber from a package to a manufacturing process. Furthermore, the present invention provides a method and apparatus for changing packages on a creel without interrupting the manufacturing process. In particular, the compact creel of the present invention provides for continuous operation of unwinding and fiber delivery by allowing a standby package to be loaded on the same mandrel as an active package that is presently being unwound.

One embodiment of the present invention is a method for positioning and loading at least one new standby package on a mandrel of a creel while an active package is being unwound, comprising: sliding a new standby package onto the mandrel adjacent to at least one of an active package and a standby package; tying a leading fiber end of the new standby package to a trailing fiber end of the at least one of an active package and standby package; inserting a mandrel core holder and an end pivot stud of a package change fixture into the mandrel and creel frame, respectively; releasing the package support assembly and pivoting the package support assembly away form the mandrel; pivoting the package change fixture, the mandrel, the mandrel support bar, and packages upward at least 10° until the end of the mandrel support bar disengages a mandrel support bolt; removing the mandrel support bar from the creel frame and form slots in the mandrel; pivoting the package change fixture, mandrel, and packages until the package change fixture contacts and is aligned with the creel frame; sliding the standby package onto the mandrel at least until the new standby package contacts at least one of the active package and a standby package and further sliding the new standby package to eject an exhausted core of an old active package from the end of the mandrel; reinserting the mandrel support bar through the slots in the mandrel and into the support bar slots of the creel frame; pivoting the package change fixture, mandrel 7 and packages upward at least 10°; pushing the mandrel support bar into the creel frame until the mandrel support bar is aligned with the mandrel support bar bolt; pivoting the package change fixture, mandrel 7 and packages back down to a normal operating position; and removing the package change fixture by pulling outward until the pivot stud and the mandrel core holder are disengaged from the creel frame and mandrel, respectively.

Another embodiment of the present invention is a method for positioning and loading at least one new standby package on a mandrel of a creel while an active package is being unwound comprising: sliding the new standby package onto the mandrel and adjacent to at least one of a standby package and an active package; tying a tail end of the fiber of at least one of an active package and a standby package to the lead end of the fiber of the new standby package; attaching a package change fixture to a creel frame to support the mandrel; inserting a mandrel core holder of the package change fixture into the mandrel and locking the mandrel core holder in place to support the packages and mandrel; releasing a package support assembly from the mandrel and pivoting the package support assembly away from the mandrel; sliding the new standby package along the mandrel until contacting at least one of the active package a standby package, and further sliding the new standby package until an exhausted core is ejected; reconnecting the package support assembly to support and secure the mandrel; unlocking the mandrel core holder of the package change fixture from the mandrel; and removing the package change fixture from the mandrel and creel frame.

Another embodiment of the present invention is a method for monitoring and adjusting the net tension of a fiber group or the tension of a single fiber by at least one of increasing, maintaining or decreasing the tension on the fiber group or fiber.

Yet another embodiment of the present invention is an apparatus for unwinding an elastomeric fiber, comprising: a creel frame; a plurality of mandrels; a plurality of active packages; at least one new standby package; a plurality of drive and tension control assemblies; a package support assembly; a package change fixture; and an electronics cabinet, wherein at least one of the plurality of active packages and the at least one new standby package are configured in-line on at least one of the plurality of mandrels, and the at least one new standby package is positioned and loaded on one of the plurality of mandrel one of the plurality of active packages is being unwound.

BRIEF DESCRIPTION OF THE DRAWINGS

FIG. 20 is an exemplary perspective view of the package change assembly of the second embodiment of the invention.

FIG. 21 is a front elevational view of the package change assembly of the second embodiment of the invention.

FIG. 22 is a top plan view of the package change assembly shown in FIG. 20.

FIG. 23 is an exemplary perspective view of a package support assembly of the second embodiment of the invention.

FIG. 24 is a front elevational view of the package support assembly shown in FIG. 23.

FIG. 25 is a top plan view of the package support assembly shown in FIG. 23.

DETAILED DESCRIPTION OF THE INVENTION

Figure 1:
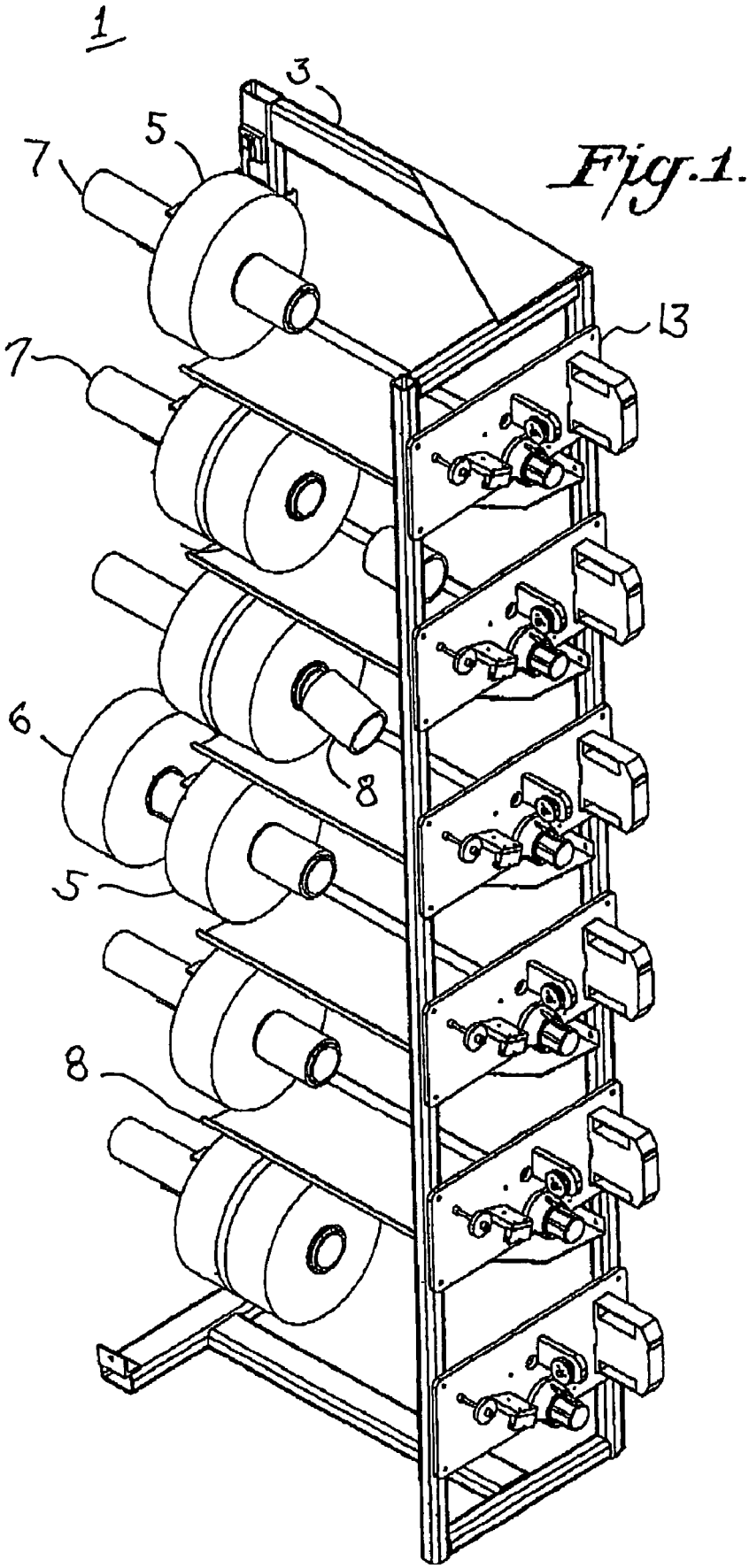
FIG. 1 is a front perspective view of a first embodiment of the present invention.

With reference to FIG. 1, a first embodiment of a compact creel system 1 of the present invention is shown from a front perspective view. As shown in FIG. 1, a frame 3 of the creel system 1 supports each package 5, 6 with a single mandrel 7 or cylindrical rod in a preferably in-line orientation. The diameter of the mandrel 7 is smaller than the diameter of the open core 8 of the packages 5, 6 such that the packages 5, 6 can slide over the mandrel 7 and such that the thread or fiber can be unwound from the active package 5 by the OETO method.

In addition, the interior of the mandrel 7 is configured to accommodate the insertion of a package change fixture 21 that allows positioning and loading of at least one standby package 6 on each mandrel 7 of the creel while fiber is being unwound from an active package 5. For example, by making the mandrel 7 hollow, the mandrel can accommodate the insertion of a package change fixture. Further the compact creel system 1 includes a tray 9 that can catch the exhausted core 8 of an active package 5 for later disposal.

Further, FIG. 1 shows drive and tension control assemblies 13 that are attached to the creel frame 3 and provide a driven roll and tension control capabilities for the compact creel system 1. The drive and tension control assembly 13 further comprises a driven take-off roll, a guide roll, a pretensioner roll, a tension sensor, a motor, and a tension controller device. Optionally, a motion sensor (not shown) and breakage sensor (not shown) may also be included. A drive and tension control assembly 13 is provided for each mandrel and the creel frame 3 is capable of supporting multiple mandrels 7 and drive and tension control assemblies 13. The drive and tension controller assembly 13 may further comprises a graphical display, a keypad or individual keys, and alarm lights. Further details of the drive and tension control assembly are provided below. Not shown in FIG. 1 is an electronic control cabinet that contains additional circuitry and wiring to support the drive and tension control assembly 13. This cabinet is typically located at the bottom of the front of the creel frame 3.

The drive and tension control assembly 13 of FIG. 1 provides tension monitoring control as the fiber unwinds from an active package 5. As the fiber unwinds from an active package 5, the fiber follows a predetermined path before reaching the drive and tension control assembly 13. Preferably the path is configured to minimize the addition of unintended tension to the elastomeric thread before reaching the drive and tension control assembly 13 whenever practically possible. More preferably the path is a relatively straight line with no sharp turns.

Figure 2:
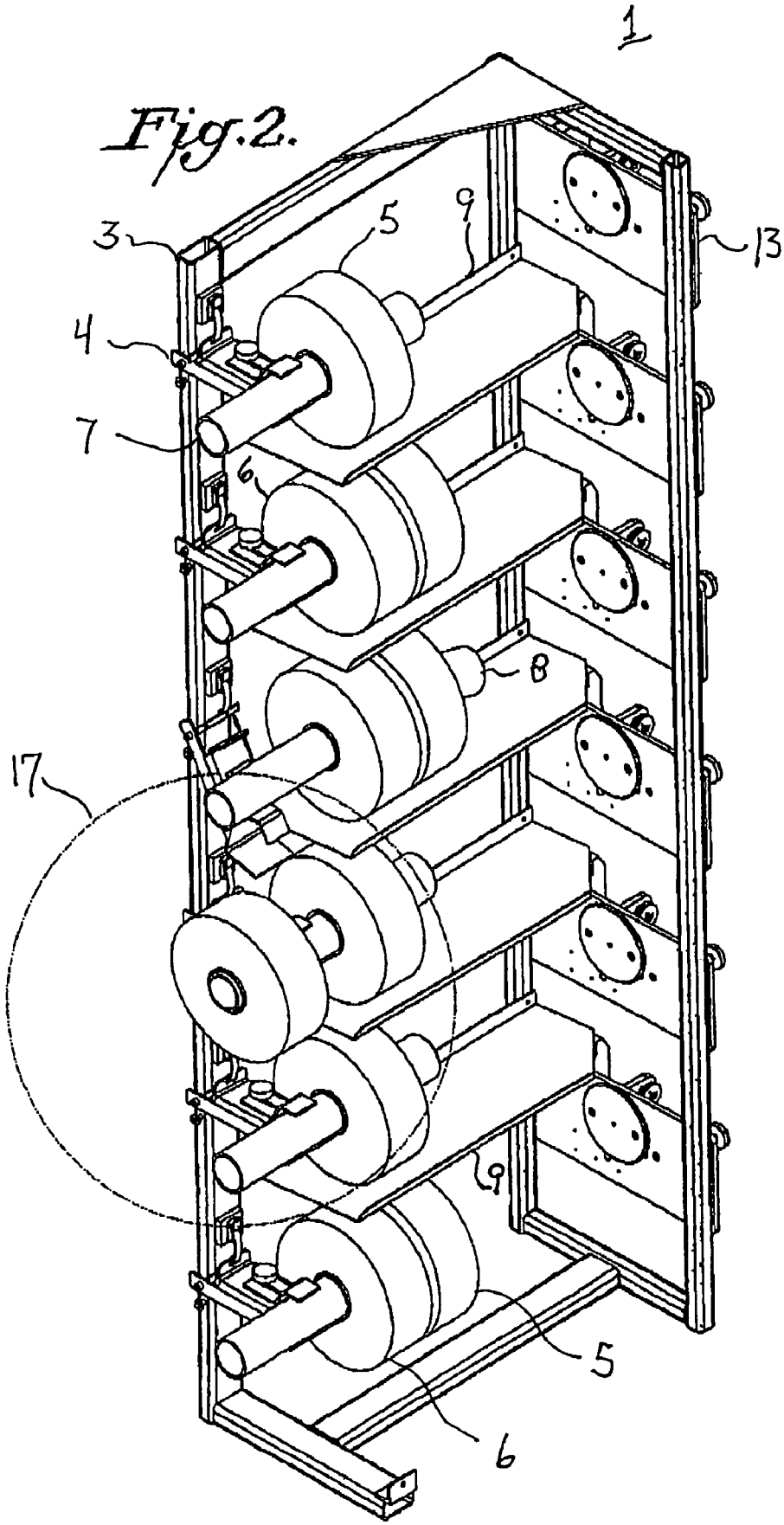
FIG. 2 is a rear perspective view of a first embodiment of the present invention.

FIG. 2 is a rear perspective view of the first embodiment of the present invention. As shown in FIG. 2, a creel frame 3 of the creel system 1 supports the packages 5, 6 with a single mandrel 7 or cylindrical rod in a preferably in-line configuration. Each mandrel 7 is removably attached to the creel frame 3 by a mandrel support assembly 4. The diameter of the mandrel 7 is smaller than the diameter of the open core 8 of packages 5, 6 such that the packages 5, 6 can slide over a mandrel 7 and such that the thread or fiber can be unwound from the active package 5 by the OETO method.

In addition, FIG. 2 shows the interior of the mandrel 7 is configured to accommodate the insertion of a package change fixture element (not shown) that allows positioning and loading of at least one standby package 6 on each mandrel 7 of the creel while fiber is being unwound from an active package 5. For example, this may be accomplished by making the mandrel 7 hollow. Further, the compact creel system 1 includes trays 9 that can catch the exhausted core 8 of a package 5 for later disposal. Further, FIG. 2 shows drive and tension control assemblies 13 that are attached to the creel frame 3 and provide a driven roll and tension control capabilities for the compact creel system 1.

Figure 3:
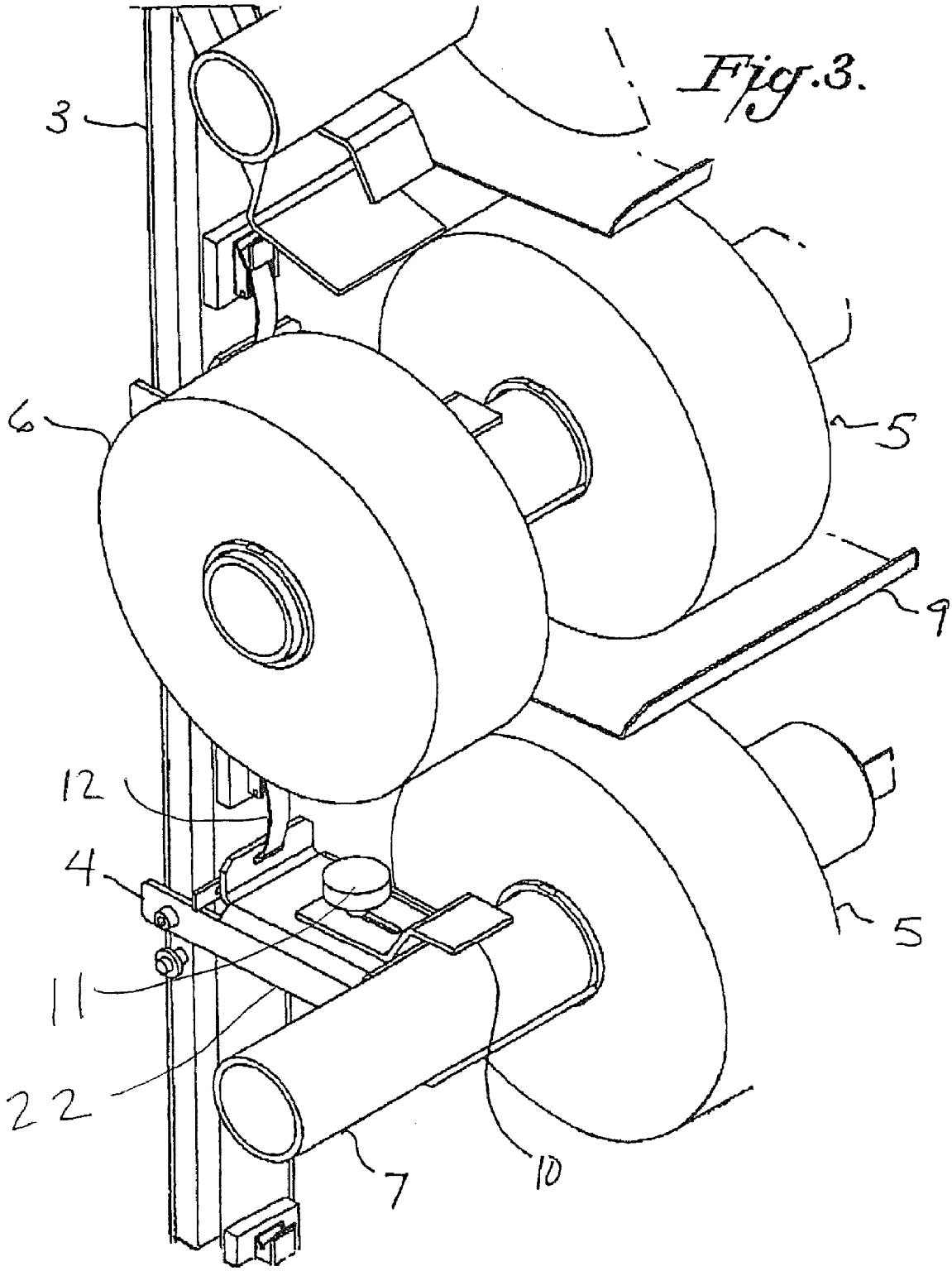
FIG. 3 is an enlarged fragmental perspective view of circled area 17 of FIG. 2.

FIG. 3 is an enlarged fragmental perspective view of circled area 17 of FIG. 2. In particular, FIG. 3 shows how the mandrel 7 may be supported on the creel and held in position through the variable adjustment of the position of a moveable upper clamp 10 of the mandrel support assembly 4. The mandrel support assembly 4 further comprises a holder 22; the moveable upper clamp 10; a thumb screw 11; and a latch 12. The holder 22 is configured to support the mandrel 7. The moveable upper clamp 10 is configured to hold the mandrel 7 in place on the holder 22 and is slotted to enable movement of the upper clamp 10. The thumb screw 11 is configured to be tightened to secure the moveable upper clamp 10 in a desired position. The latch 12 is configured to hold the support assembly 4 in place.

Figure 5:
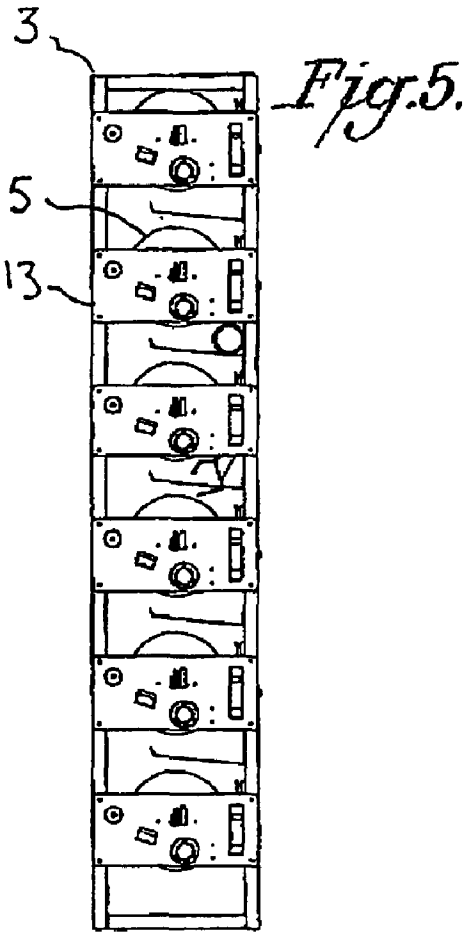
FIG. 5 is a front elevational view of the first embodiment of the present invention.
Figure 4:
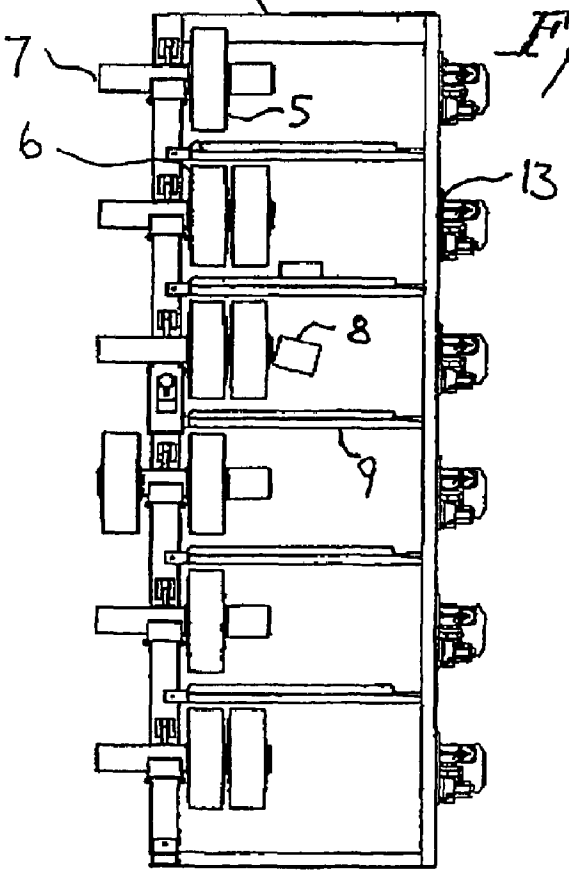
FIG. 4 is a side elevational view of the first embodiment of the present invention.

FIG. 4 and FIG. 5 are side elevational and front elevational views, respectively, of the compact creel system 1. In particular, FIG. 5 shows a support frame 3 with six mandrels 7, where each mandrel is holding at least one of an active package 5 and a standby package 6. In addition FIG. 5 shows six drive and tension control assemblies 13 mounted on the creel frame 3. Further, a package change fixture (not shown) provides support for the packages 5, 6 during the positioning and loading of a new standby package 6 on a mandrel 7. The method and apparatus for loading a standby package 6 while an active package 5 is unwinding on the same mandrel 7 is detailed below.

Figure 6:
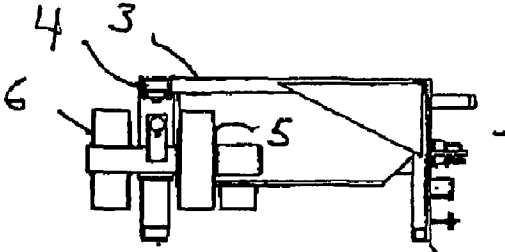
FIG. 6 is a top plan view of the first embodiment of the present invention.

FIG. 6 is a top plan view of the compact creel system 1 shown in FIG. 4 and FIG. 5. As shown, the compact creel system 1 is configured as a single compact creel. In alternative embodiments, the compact creel system 1 may comprise a combination of a large number of single compact creel systems that define a larger composite system. In all embodiments of the present invention, support frame 3, packages 5, 6, mandrels 7 and drive and tension control assemblies 13 cooperate to provide the compact creel system 1 with a method for monitoring and adjusting the net tension of a thread group or the tension of a single thread by at least one of increasing, maintaining or decreasing the thread tension of the thread group or thread; and providing uniformity and increased efficiency to the operation of the compact creel system. In addition, the compact creel of the present invention provides for continuous operation of unwinding and fiber delivery by allowing a standby package to be loaded on the same mandrel from which an active package is being unwound.

Figure 7:
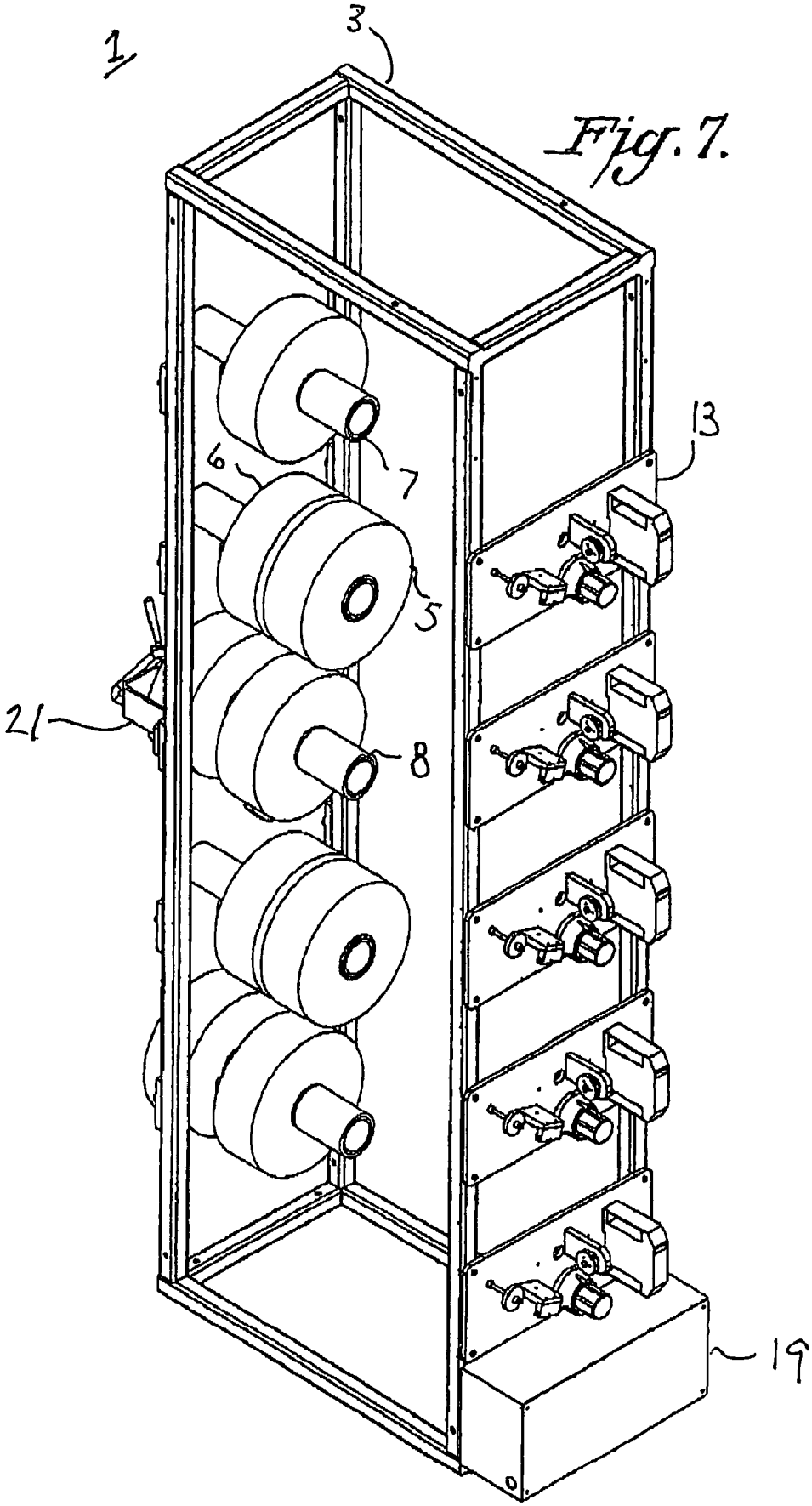
FIG. 7 is a front perspective view of a second embodiment of the present invention.

FIG. 7 is a front perspective view of a second embodiment of the present invention. As shown in FIG. 7, a frame 3 of the creel system 1 supports each package 5, 6 with a single mandrel 7 or cylindrical rod in a preferably in-line orientation. The diameter of the mandrel 7 is smaller than the diameter of the open core 8 of the package 5 such that the package 5, 6 can slide over the mandrel 7 and such that the thread or fiber can be unwound from the active package 5 by the OETO method.

In addition, the interior of the mandrel 7 is configured to accommodate the insertion of a package change fixture 21 that allows positioning and loading at least one standby package 6 on each mandrel 7 of the compact creel while fiber is being unwound from an active package 5. For example, this may be accomplished by making the mandrel 7 hollow. Further, the compact creel system 1 may include trays 9 (not shown) that can catch an exhausted core 8 of a previously active package 5 for later disposal.

Further, FIG. 7 shows drive and tension control assemblies 13 that are attached to the frame 3 and provide a driven roll and tension control capabilities for the compact creel system 1. The drive and tension control assembly 13 further comprising a driven take-off roll, a guide roll, a tension sensor, a pretensioner guide roll, a motor and a tension controller device. Optionally, a motion sensor (not shown) and breakage sensor (not shown) may also be included. A drive and tension control assembly 13 is provided for each mandrel and the frame is capable of supporting multiple mandrels. The drive and tension controller 13 assembly further comprises a graphical display, a keypad or individual keys, and alarm lights. Further details of the drive and tension control assembly 13 are provided below. An electronics cabinet 19 contains additional circuitry and wiring to support the drive and tension control assembly 13. For example, as shown in FIG. 7, the electronics cabinet 19 may be located at the bottom of the front of the creel frame 3.

The drive and tension control assembly 13 of FIG. 7 provides tension monitoring control as the fiber unwinds from an active package 5. As the fiber unwinds from an active package 5, the fiber follows a predetermined path before reaching the drive and tension control assembly 13. Preferably the path is configured to minimize the addition of unintended tension to the elastomeric thread before reaching the drive and tension control assembly 13 whenever practically possible. More preferably the path is a relatively straight line with no sharp turns or angles.

Figure 8:
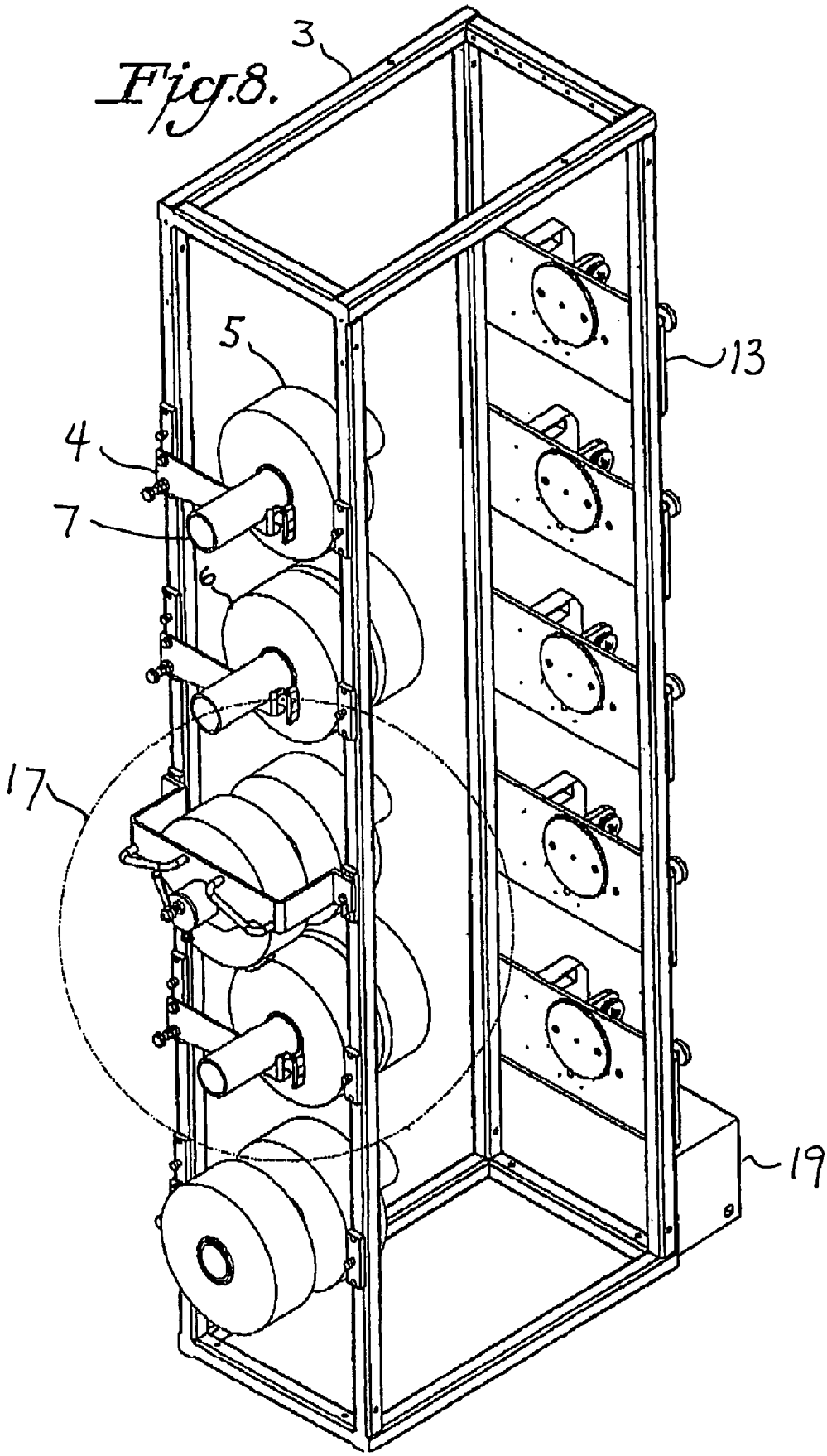
FIG. 8 is a rear perspective view of a second embodiment of the present invention.

FIG. 8 is a rear perspective view of a second embodiment of the present invention. As shown in FIG. 8, a frame 3 of the creel system 1 supports each package 5 with a single mandrel 7 or cylindrical rod in a preferably in-line orientation. Each mandrel 7 is removably attached to the creel frame 3 by a mandrel support assembly 4. The diameter of the mandrel 7 is smaller than the diameter of the open core 8 of packages 5, 6 such that the packages 5, 6 can slide over the mandrel 7 and such that the thread or fiber can be unwound from the active package 5 by the OETO method.

In addition, FIG. 8 shows the interior of the mandrel 7 is configured to accommodate the insertion of a package change fixture element 21 that enables allows positioning at least one standby package 6 to each mandrel 7 of the creel while fiber is being unwound from an active package 5. For example, this may be accomplished by making the mandrel 7 hollow. Further the compact creel system 1 includes trays 9 (not shown) that can catch the exhausted core 8 of a previously active package 5 for later disposal. Further, FIG. 8 shows drive and tension control assemblies 13 that are attached to the frame 3 and provide a driven roll and tension control capabilities for the compact creel system 1.

Figure 9:
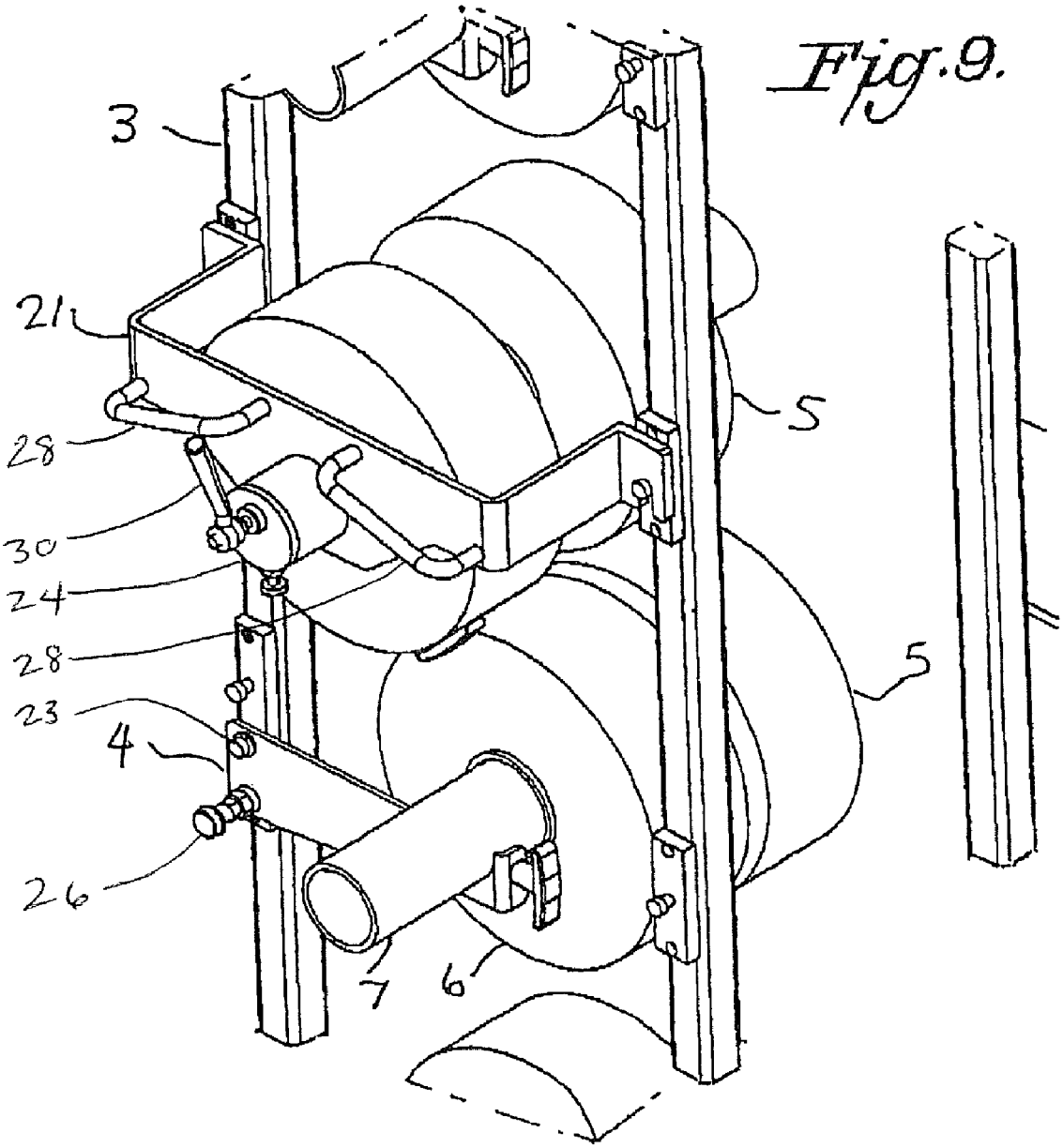
FIG. 9 is an enlarged fragmental right side perspective view of circled area 17 of FIG. 8.
Figure 10:
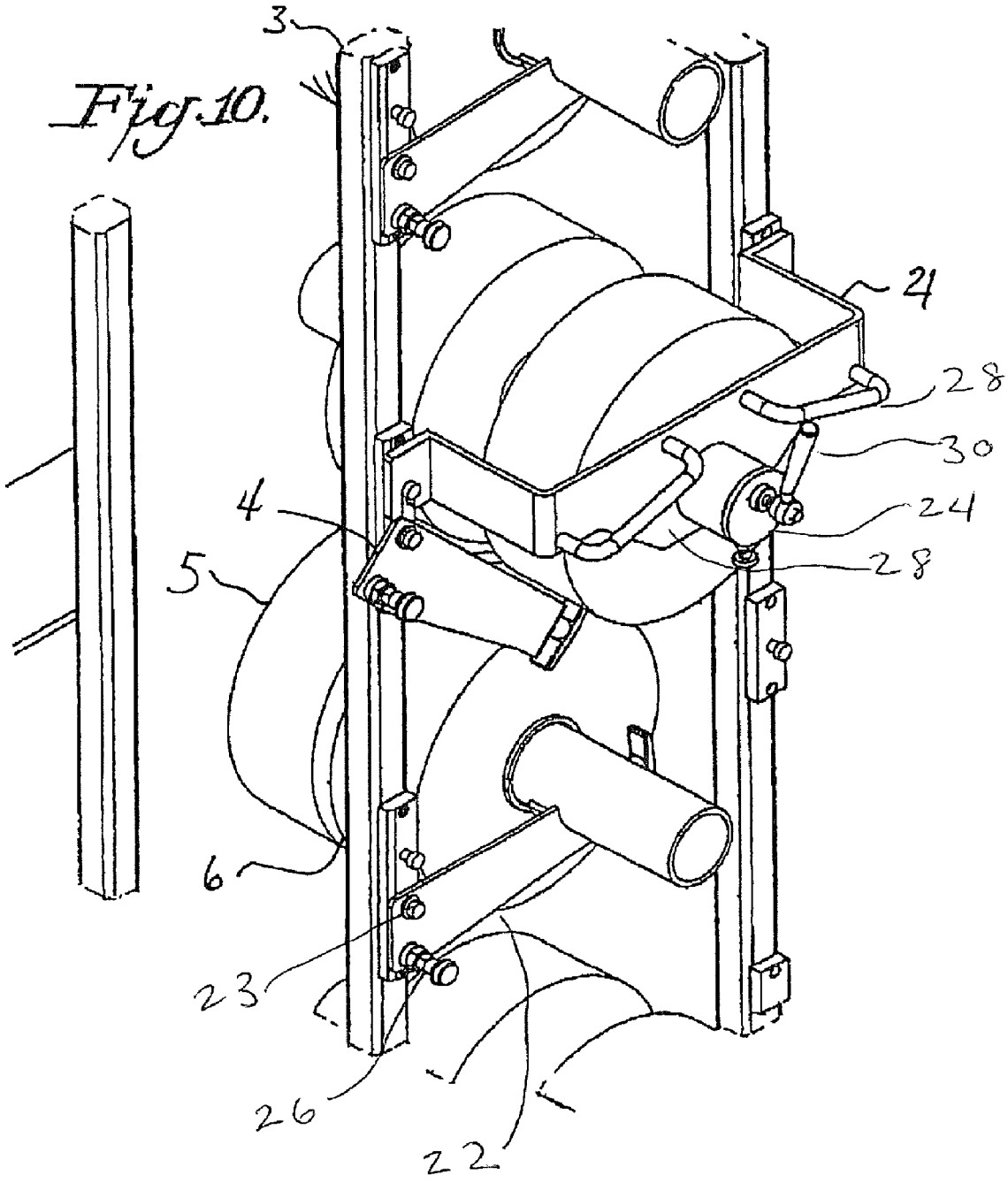
FIG. 10 is an enlarged fragmental left side perspective view of circled area 17 of FIG. 8.

FIG. 9 is an enlarged fragmental perspective view of circled area 17 of FIG. 8. In particular, FIG. 9 shows how the mandrel 7 may be supported on the creel and held in position by the mandrel support assembly 4. The mandrel support assembly 4 may be released by manipulating locking pin 26. In particular, mandrel support assembly 4 swings away and downward with a semicircular motion, as shown in FIG. 10. When the mandrel support assembly 4 is swung out of the way (i.e., pivoted), the package change assembly 21 supports the mandrel 7 and the packages 5, 6. This allows standby package 6 and active package 5 to be moved forward on mandrel 7 and to eject the exhausted core 8. The lead end of the fiber of a new standby package 6 can be attached to a tail end of the fiber of the active package 5 or of an additional standby package located ahead of the new standby package. The method for positioning and loading a standby package is discussed in further detail below.

In addition, as shown in FIG. 10, mandrel 7 has a slot that is positioned perpendicular to the longitudinal axis of the tube of the mandrel 7 that allows packages 5, 6 to be held in place when the mandrel 7 is seated on a mandrel support bar 22 of the mandrel support assembly 4. Moreover, as shown in FIG. 9 and FIG. 10, the mandrel support assembly 4 further comprises a mandrel support bar 22; a mandrel support bar bolt 23, a pivot stud 26. Furthermore, the package change fixture 21 further comprises a mandrel core holder 24; handles 28; and a control handle 30.

Figures 11, 12, 13:
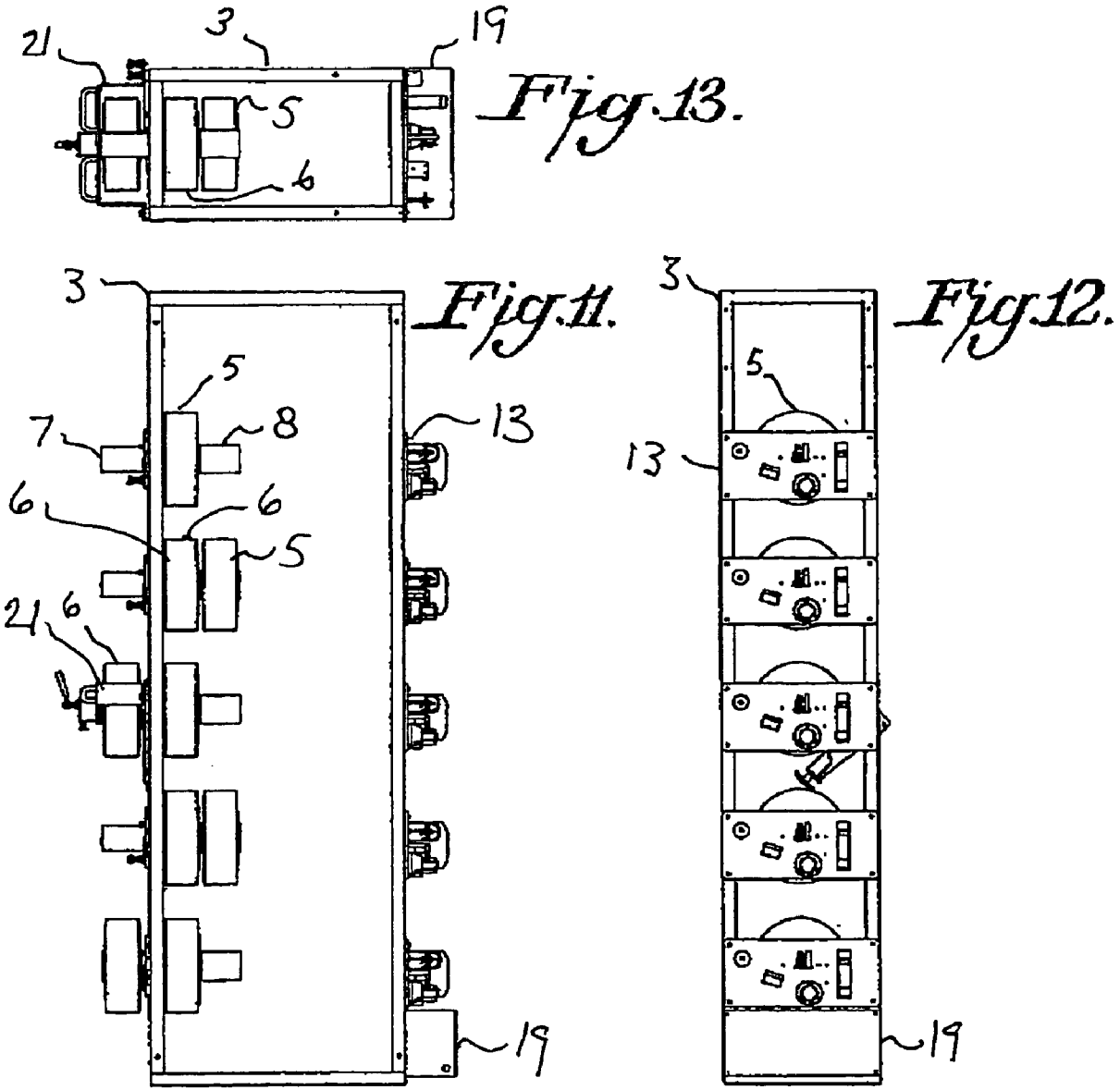
FIG. 11 is a side elevational view of the second embodiment of the present invention.
FIG. 12 is a front elevational view of the second embodiment of the present invention.
FIG. 13 is a top plan view of the second embodiment of the present invention.

FIG. 11 and FIG. 12 are side elevational and front elevational views, respectively, of the compact creel system 1. In particular, FIG. 12 shows a creel frame 3 with five mandrels 7, where each mandrel is holding at least one of an active package 5 and a standby package 6. The creel frame 3 of FIG. 12 is capable of holding up to six mandrels and six drive and tension control assemblies 13 when fully loaded. Further, FIG. 11 and FIG. 12 show a package change fixture 21 that provides support for the packages 5, 6 during the positioning and loading of at least one new standby package 6 for loading on a mandrel 7 of the creel. The method and apparatus for loading a standby package 6 while an active package 5 is unwinding on the same mandrel 7, is discussed in detail below.

FIG. 13 is a top plan view of the compact creel system 1 shown in FIG. 11 and FIG. 12. As shown, the compact creel system 1 is configured as a single unit. In alternative embodiments, the compact creel system 1 may comprise a combination of a number of single compact creel systems that define a larger composite creel system. In all embodiments of the present invention, creel frame 3, packages 5, 6, mandrels 7 and drive and tension control assemblies 13 cooperate to provide the compact creel system 1 with a method for monitoring and adjusting the net tension of a thread group or the tension of a single thread by at least one of increasing, maintaining or decreasing the thread tension of the thread group or thread; and providing uniformity and increased efficiency to the operation of the compact creel system. In addition, the compact creel of the present invention provides for continuous operation of unwinding and fiber delivery by allowing a standby package to be loaded on the same mandrel as an active package that is being unwound.

An exemplary method for operating the compact creel system 1 of both embodiments of the present invention comprising: a) placing active packages 5 and standby packages 6 on their respective mandrels 7; b) tying the lead end of a fiber from each standby package 6 to a tail end of a fiber of a corresponding active package 5 located on the same mandrel 7; c) directing the leading fiber end of each active package 5 through the respective static guide 27 and pre-tensioning guide roll 29 of the drive assembly 13 that corresponds to each mandrel 7 and then through a wrap of 270° or less around a driven roll 25 of the drive and tension control assembly 13 configured to control tension in the fiber to be within predetermined tension ranges; causing the fiber to be engaged by a take-up device (i.e., not shown in FIG. 1 but typically a driven roll or set of driven rolls, representing that element of the manufacturing process which first engages the fiber as it exits the unwinder); d) controlling the speed of unwinding the active package 5 to achieve a desired fiber elongation (i.e., draft); and e) replacing each active package 5, before it becomes exhausted, with a standby package 6 that then becomes a new active package 5.

In particular, repeating steps a) through e), as required, allows continuous operation of the compact creel system 1. The compact size of the creel system 1 allows a large number of yarns to be delivered from a small footprint that takes up a reduced amount of space on the manufacturing floor in comparison to background art creel systems.

Figures 14, 15:
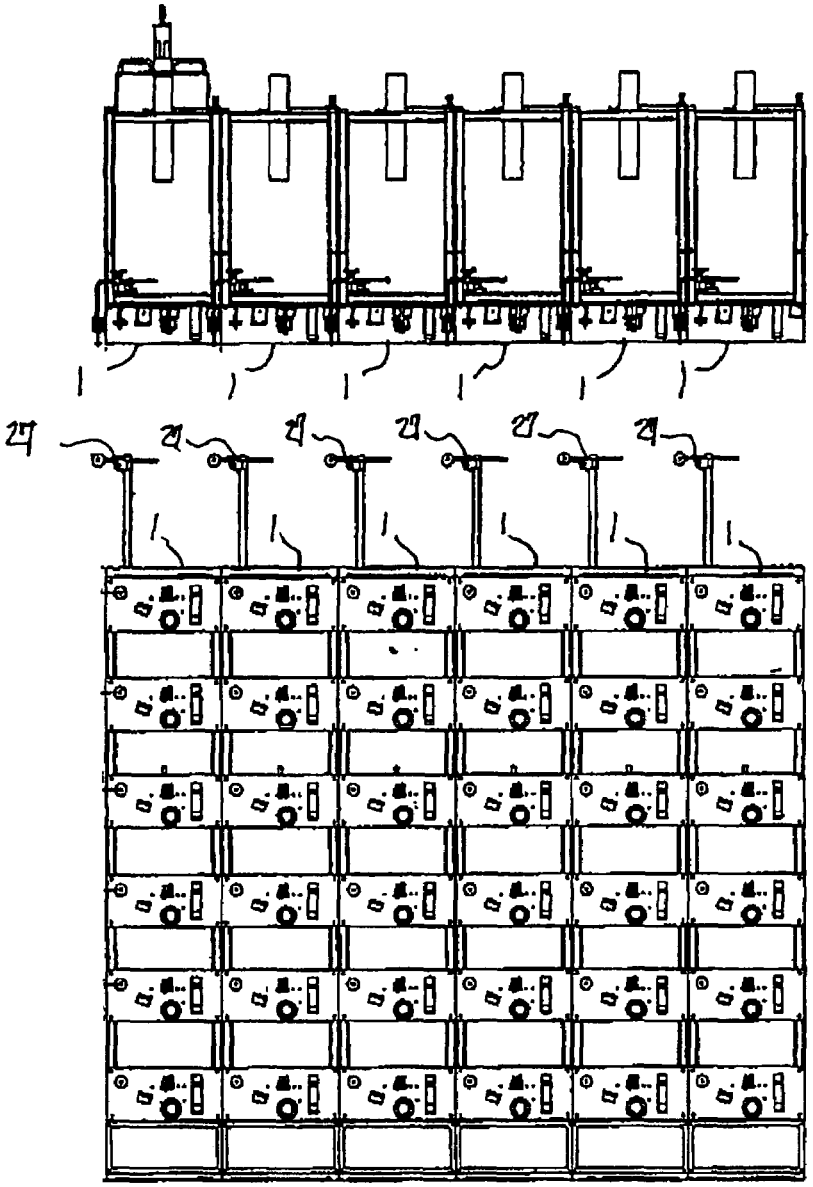
FIG. 14 is a front elevational view of multiple single mandrel creels of the present invention combined to form a fiber feeding system.
FIG. 15 is a top plan view of multiple single mandrel creels combined to form a fiber feeding system.

FIG. 14 is a front elevational view of multiple compact creel systems 1 of the present invention combined to form a larger compact fiber feeding or delivery system. Each compact creel system 1 includes multiple idler assemblies 27 for directing the tension controlled fibers to a manufacturing process. FIG. 15 is a top plan view of the multiple compact creels shown in FIG. 14.

Figures 16, 17, 18, 19:
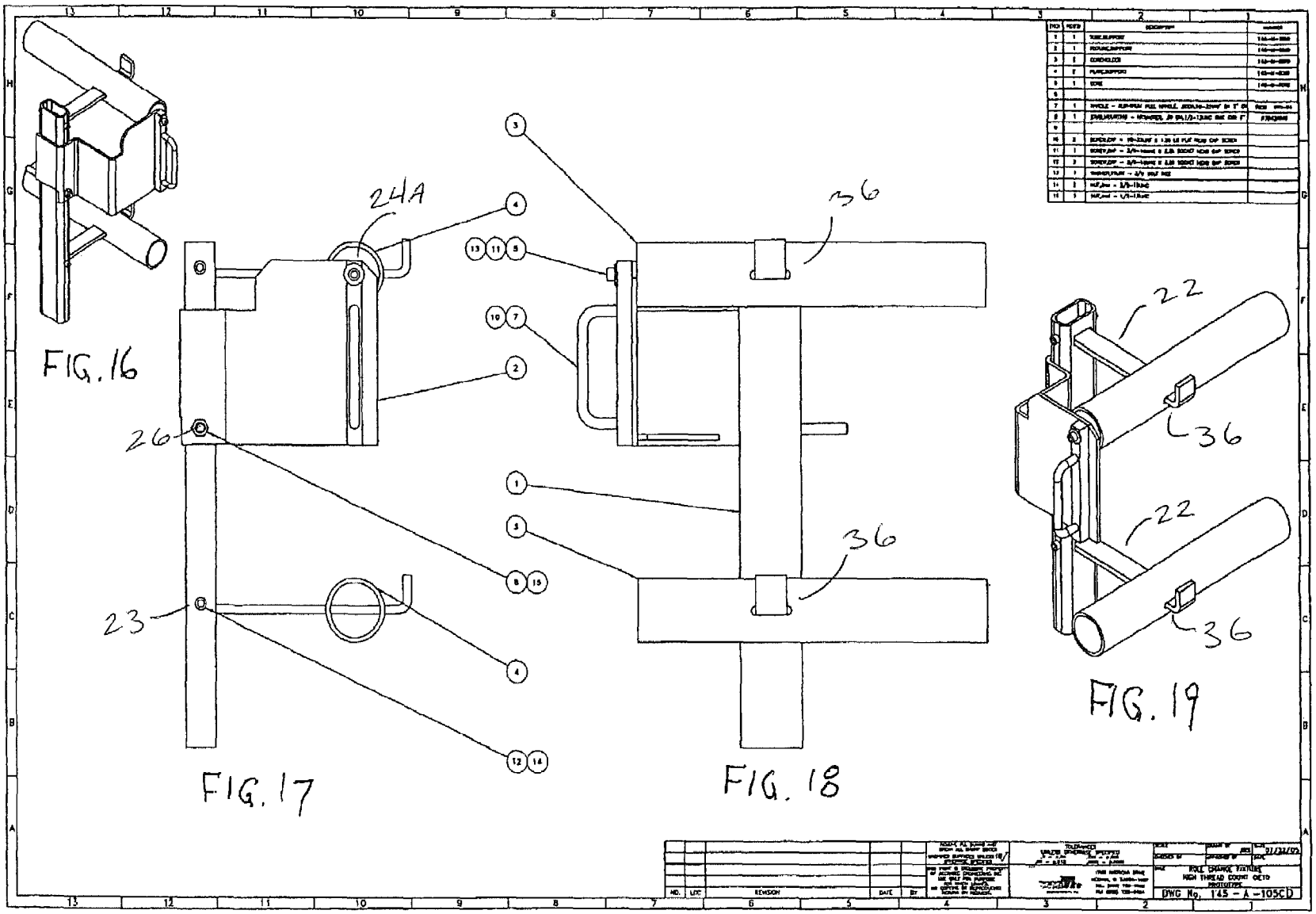
FIG. 16 is an exemplary front perspective view of a package change assembly for a first embodiment of the present invention.
FIG. 17 is a front elevational view of the package change assembly shown in FIG. 16.
FIG. 18 is a side elevational view of the package change assembly shown in FIG. 16.
FIG. 19 is another exemplary front perspective view of a package change assembly for a first embodiment of the present invention.

FIG. 16 is an exemplary front perspective view of a package change assembly 21 for a first embodiment of the present invention. FIG. 17 is a front elevational view of the package change assembly shown in FIG. 16. FIG. 18 is a side elevational view of the package change assembly shown in FIG. 16. FIG. 19 is another exemplary front perspective view of a package change assembly for a first embodiment of the present invention. As shown in FIG. 17, FIG. 18 and FIG. 19, the mandrel support assembly 4 further comprises a mandrel support bar 22 and is held in place by a mandrel support bolt 23. The mandrel support bar 22 passes through horizontal slots 36 in each side of the mandrel 7 in order to hold the mandrel 7 in place on the creel.

In addition, as shown in FIG. 17, FIG. 18 and FIG. 19, the package change fixture 21 further comprises a mandrel support bar 22; a mandrel core holder 24A; a pivot stud 26; and handle 28. The pivot stud 26 is attached through the lower left hand corner of the package change fixture 21 and to the creel frame 3. An exemplary method for positioning and loading at least one standby package 6 on a mandrel 7 while an active package is being unwound with this embodiment of the package change assembly is discussed below and shown in the flow diagram of FIG. 30.

FIG. 20 is an exemplary front perspective view of the package change assembly 21 of the second embodiment of the invention. FIG. 21 is a front elevational view of the package change assembly 21 of the second embodiment of the invention shown in FIG. 20. FIG. 22 is a top plan view of the package change assembly 21 shown in FIG. 20.

In addition, as shown in FIG. 20, FIG. 21 and FIG. 22, the package change fixture 21 further comprises a mandrel core holder 24A; handles 28; a control handle 30; a collar 32; and a cam 38. An exemplary method for positioning at least one standby package on a mandrel while an active package is being unwound with this embodiment of the package change assembly is discussed below and shown in the flow diagram of FIG. 31.

FIG. 23 is an exemplary perspective view of the mandrel support assembly 4 for the second embodiment of the present invention. FIG. 24 and FIG. 25 are front elevational and top plan views, respectively of FIG. 23. In addition, as shown in FIG. 23, FIG. 24 and FIG. 25, the mandrel support assembly 4 further comprises a mandrel support bar 22; a mandrel support bar bolt 23; a mandrel core holder 24B; a pivot stud 26; and handle 34. The pivot stud 26 is attached through the lower left hand corner of the mandrel support assembly 4 and to the creel frame 3. In addition, the pivot stud 26 is a locking pin that holds the support bar 22 in position.

Figures 26, 27, 28, 29:
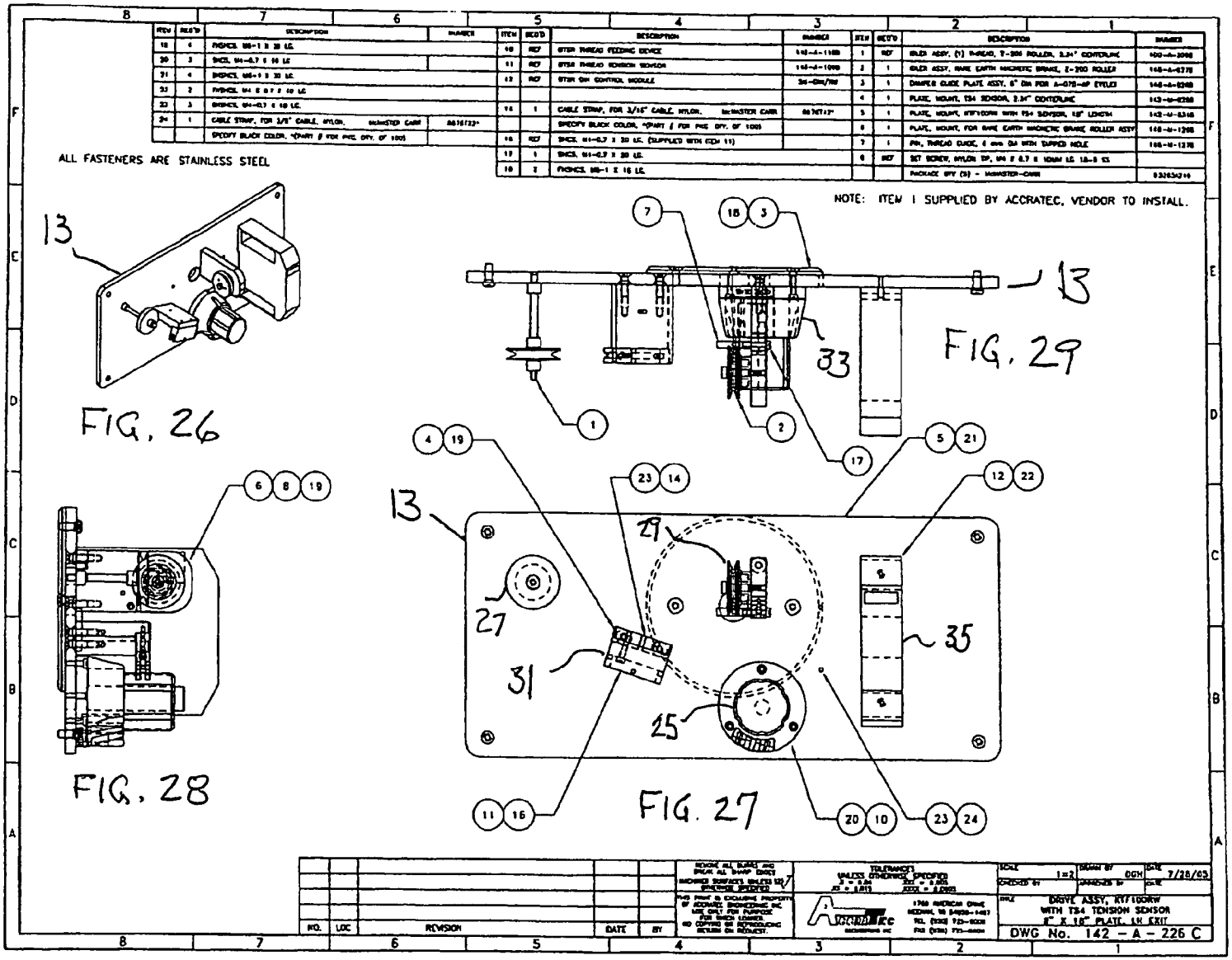
FIG. 26 is an exemplary front perspective view of the drive and tension control assembly of both embodiments of the invention.
FIG. 27 is a front elevational view of the drive and tension control assembly shown in FIG. 26.
FIG. 28 is side elevational view of the drive and tension control assembly shown in FIG. 26.
FIG. 29 is a top plan view of the drive and tension control assembly shown in FIG. 26.

FIG. 26 is an exemplary front perspective view of the drive assembly 13 of both embodiments of the invention. FIG. 27 is a front elevational view of the drive assembly shown in FIG. 26. In particular, FIG. 26 is an exemplary perspective view of a single thread drive on the tension control assembly 13. As shown in FIG. 27, the drive and tension control assembly 13 comprises a driven take-off roll 25, a guide roll 27, a pretension guide roll 29 a tension sensor 31, a variable speed motor 33 and a tension controller device 35. Optionally, a motion sensor and breakage sensor (not shown) may also be included. The tension controller device 35 further comprises a graphical display, a keypad or individual keys, and alarm lights. FIG. 28 is side elevational view of the drive and tension control assembly 13 shown in FIG. 26. FIG. 29 is a top plan view of the drive and tension control assembly 13 shown in FIG. 26.

According to a preferred embodiment, a user enters a desired tension range that is to be maintained for the thread directly into tension controller device 35. The tension controller device receives input signals from the tension sensor 31 representative of the thread tension. Tension controller device 35 uses these input signals to determine whether the tension level of the thread coming off driven take-off roll 25 can be maintained because it is within the desired tension range, or whether the tension needs to be increased or decreased. Variable-speed motor 33 of the drive and tension control assembly 13 will maintain a speed until tension controller device 35 outputs a signal indicating that the net tension is outside the desired range based on a signal received from the tension sensor 31. The output signal from tension sensor 31 will override an input signal from a manufacturing process and change the speed of the variable speed motor 33 of the drive and tension control assembly 13 until the speed is within the desired range. That is, the speed of variable speed motor 33 will be adjusted to correct for variations in tension that occur during unwinding or the thread feeding process.

Table 1 shows examples of thread line tension variations, as measured at a sensor, as the distance, d, between the package and a static guide was varied over a distance between about 0.25 and 0.81 meter. These thread line tension variations are examples that may be used to determine a desired or predetermined range of tensions for the present invention.

TABLE 1

| Distance (meter) | Mean Range Tension (grams) | Max. Tension (grams) |
|---|---|---|
| 0.27 | 16.90 | 50.00 |
| 0.28 | 17.60 | 50.00 |
| 0.30 | 17.80 | 50.00 |
| 0.33 | 16.30 | 50.00 |
| 0.36 | 1630 | 49.00 |
| 0.38 | 14.50 | 50.00 |
| 0.41 | 13.70 | 48.40 |
| 0.43 | 13.30 | 38.00 |
| 0.46 | 12.40 | 37.10 |
| 0.48 | 12.20 | 44.70 |
| 0.51 | 11.60 | 36.30 |
| 0.53 | 11.60 | 36.70 |
| 0.56 | 11.60 | 30.40 |
| 0.58 | 11.80 | 32.60 |
| 0.61 | 10.00 | 28.80 |
| 0.64 | 10.60 | 34.30 |
| 0.66 | 10.60 | 25.30 |
| 0.69 | 10.40 | 34.30 |
| 0.71 | 10.60 | 29.80 |
| 0.74 | 10.00 | 28.40 |
| 0.76 | 10.40 | 29.40 |
| 0.79 | 10.80 | 27.80 |
| 0.80 | 10.80 | 34.50 |

Table 1 demonstrates that thread line tension (expressed either as the mean range or the maximum tension) decreases as the distance between the package and the static guide is increased. Minimum tensions, not shown in the table ranged from about 0.6 to 1.4 grams. Unexpectedly, it has been discovered that there is a minimum distance of about 0.41 meter below which the absolute level of tension and the tension variability (as observed by plotting, for example, maximum tension versus distance) rises to an unacceptably high level identifiable by the occurrence of threadline breakages which are usually preceded by a relatively abrupt increase in mean range tension.

If the tension controller device 35 determines that the thread tension after driven take-off roll 25 is too high, the tension controller device 35 will increase the speed of motor 33. Alternatively, if the tension controller device 35 determines that the thread tension after driven take-off roll 25 is too low, the tension controller device 35 will decrease the speed of motor 33.

As described above, drive and tension controller assembly 13 may be configured to look at a signal from a manufacturing process device as well as a signal from the tension sensor 31 in determining the appropriate speed for motor 33. In alternative embodiments, the drive and tension control assembly 13 of the manufacturing process may be configured to look only at a signal from tension sensor 31 (i.e., a tension feedback signal) in determining the appropriate speed for motor 33. Further, a large compact creel system may include multiple sensors positioned throughout the system that determine the appropriate speed of the motor 33.

According to a preferred embodiment, the speed of motor 33 is controlled without receiving input from an external manufacturing processing system (e.g., a diaper machine). That is, the motor speed is based solely on tension feedback detected by tension sensor 31 and recognized by tension controller device 35.

In addition, to reduce the likelihood of slack in the thread before reaching driven take-off roll 25, a pretensioner may be used in the pretensioner guide roll 29. Background art pretensioners rely on friction between the thread and the pretensioner to maintain tension in the thread feeding system and avoid slack in the thread. However, such friction-type pretensioners are not applicable to elastomeric threads where tack is an issue. Accordingly, pretensioner guide roll 29 uses a pretensioner which otherwise hinders the speed of rotation of the pretensioner guide roll 29. In a preferred embodiment for pretensioner guide roll 29, a magnet is positioned adjacent to pretensioner guide roll 29 and a material that is coupled to the guide roll. The material to be coupled to the guide roll is, for example, a ferrous metal such as steel. The magnetic force slows the rotational speed of the pretensioner guide roll 29 and thereby maintains the tension and eliminates slack in the thread without relying on friction.

Figure 30:
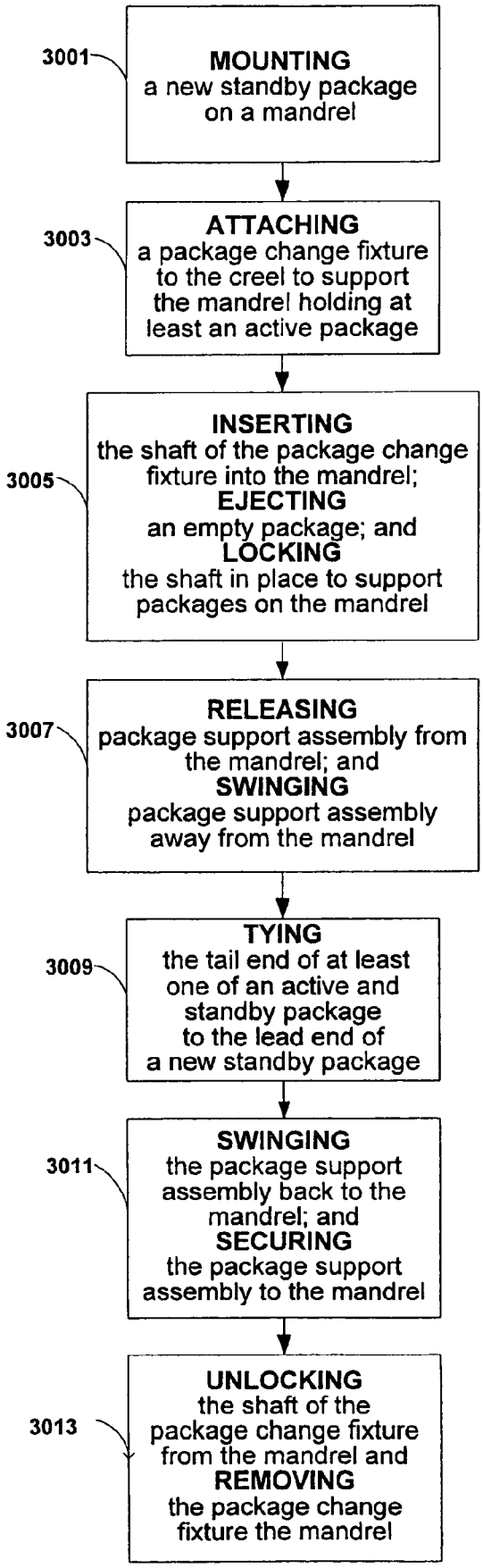
FIG. 30 shows an exemplary flow diagram for a method of positioning and loading at least one new standby package onto a mandrel of a creel while an active package is being unwound with a first embodiment of the present invention.

FIG. 30 shows an exemplary flow diagram for a method of positioning and loading at least one standby package on a mandrel of a creel while an active package is being unwound with a first embodiment of the present invention. In step 3001 of FIG. 30, new standby package 6 slides onto the mandrel 7 adjacent to at least one of an active package 5 and a standby package 6. A leading end of the fiber of the new standby package 6 is tied to a tail end of the fiber of the active package 5 in step 3003. In step 3005, an end pivot stud 26 on the package change fixture 21 is inserted in the creel frame 3. A mandrel core holder 24 is then lined up with the opening inside the core of the mandrel 7 and pushed inside of the mandrel 7 until the mandrel core holder 24 is fully engaged with the mandrel 7 in step 3005. In step 3007, the package change fixture 21 pivots the mandrel 7, the mandrel support bar 22, and the packages 5, 6 upward at least 10.degree. until the end of the mandrel support bar 22 disengages the mandrel support bolt 23. In step 3008, the package change fixture 21, mandrel and packages are pivoted upward at least 10.degree. to disengage the mandrel support bolt. The mandrel support bar 22 is removed from the creel frame 3 and through the slots 36 in the mandrel 7 in step 3009. In step 3011, the package change fixture 21, mandrel 7 and packages 5, 6 are pivoted back until the package change fixture 21 contacts and is aligned with the creel frame 3. The standby package 6 is slides onto the mandrel 7 at least until the standby package 6 contacts the active package 5 and, if necessary, the standby package 6 slides even further onto the mandrel until an exhausted core 8 is ejected from the end of the mandrel 7 in step 3013. In step 3015, the mandrel support bar 22 is reinserted through the slots 36 in the mandrel 7 and into the support bar slot of the creel frame 3. The package change fixture 21, mandrel 7 and packages 5, 6 are pivoted upward at least 10.degree. in step 3017. In step 3019, the mandrel support bar 22 is pushed into the creel frame 3 until the mandrel support bar 22 is aligned with the mandrel support bar bolt 23. The package change fixture 21, mandrel 7 and packages 5, 6 are pivoted back down to a normal operating position in step 3021. In step 3023, the package change fixture 21 is removed by pulling outward until pivot stud 26 and the mandrel core holder 24 are disengaged from the creel frame 3 and mandrel 7, respectively.

Figure 31:
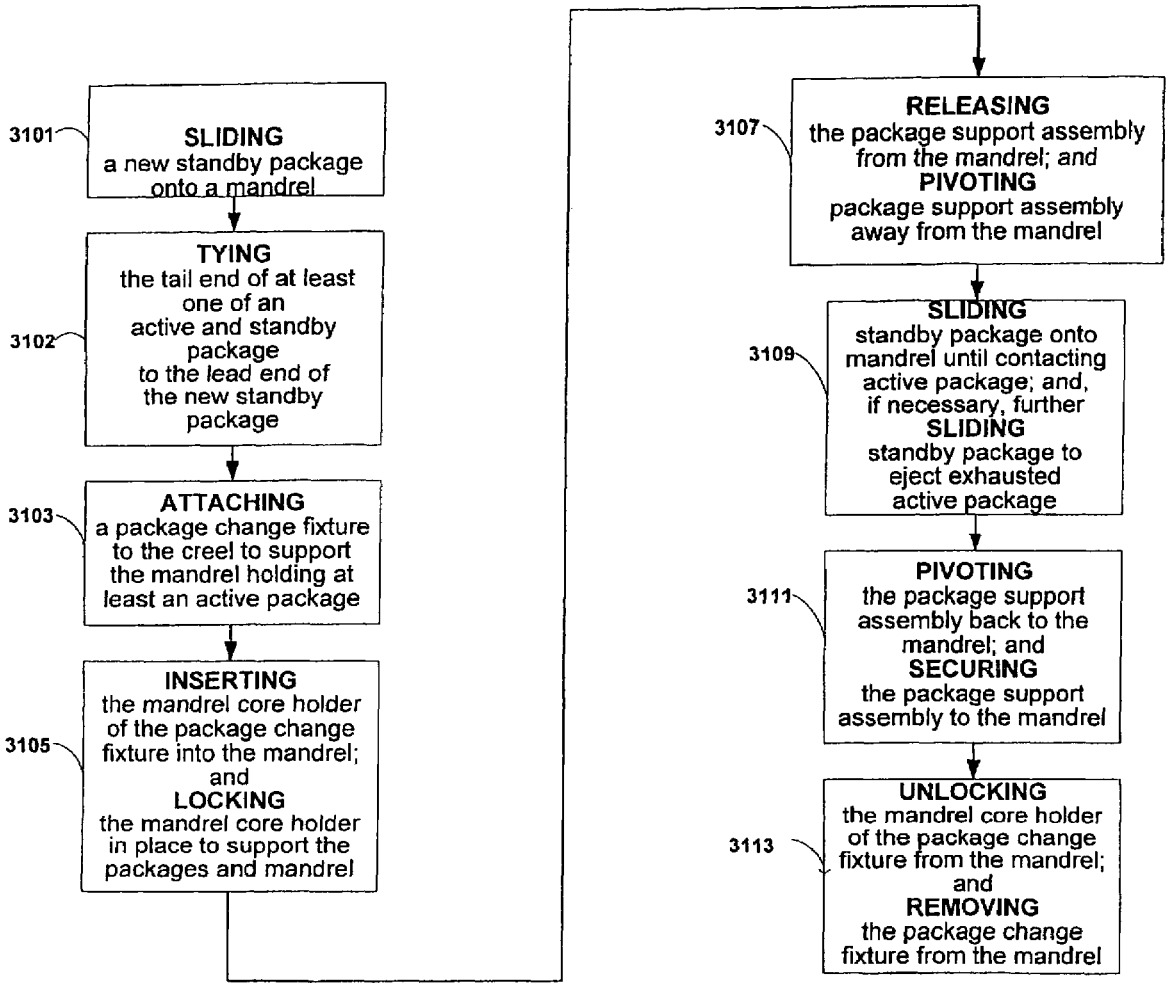
FIG. 31 shows an exemplary flow diagram for a method of positioning and loading at least one new standby package onto a mandrel of a creel while an active package is being unwound with a second embodiment of the present invention.

FIG. 31 shows an exemplary flow diagram for a method of positioning and loading at least one new standby package on a mandrel for loading on a creel while an active package is being unwound with a second embodiment of the invention. In Step 3101 of FIG. 31, a new standby package 6 is slid onto a mandrel 7 adjacent to at least one of an active package 5 and a standby package 6. The tail end of the fiber of at least one of an active package 5 and a standby package 6 is tied to the lead end of the fiber of a new standby package 6 in Step 3102. In step 3103, a package change fixture 21 is attached to the creel to support the mandrel 7 that is holding at least one of an active package 5 and a standby package 6. The mandrel core holder 24 of the package change fixture 21 is inserted into the mandrel 7 and the mandrel core holder 24 is locked in place to support packages 5, 6 on the mandrel 7 in step 3105. In step 3107, the package support assembly 4 is released from the mandrel and swung away (i.e., pivoted) from the mandrel. A new standby package 6 is slid along the mandrel 7 until contacting at least one of the active package 5 and a standby package 6, and if necessary, the new standby package 6 is slid further until an exhausted core 8 is ejected in step 3109. In step 3111, the package support assembly 4 is reconnected to support and secure the mandrel 7. The mandrel core holder 24 of the package change fixture 21 is unlocked and disengaged from the mandrel 7 and the package change fixture 21 is removed from the mandrel 7 in step 3113.

Figure 32:
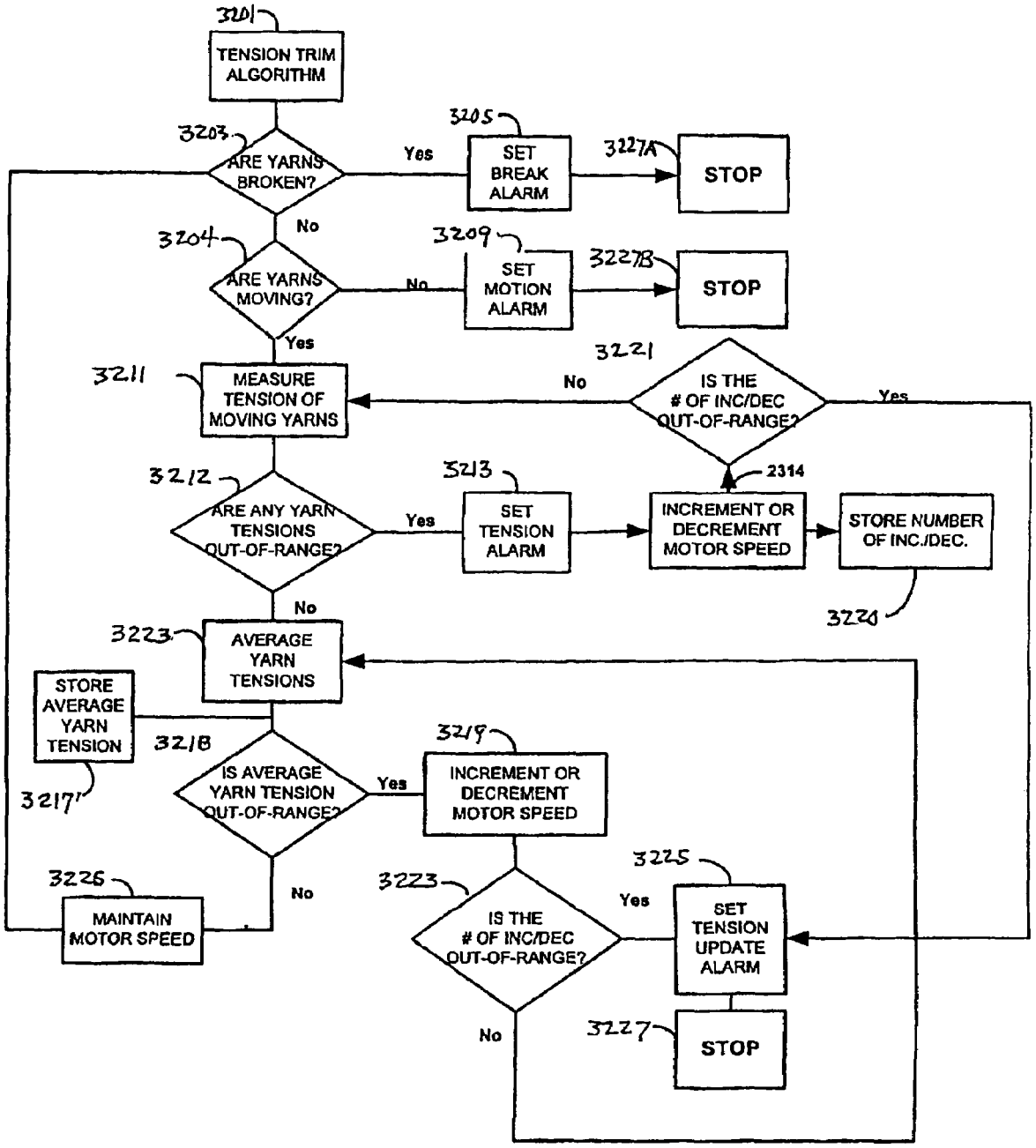
FIG. 32 shows a flow diagram for the tension trim algorithm for a method for monitoring threads or fiber tension of the present invention.

FIG. 32 shows a flow diagram for the tension trim algorithm 3201 of the method of monitoring threads or fiber tension of the present invention. In step 3203 of FIG. 32, the method determines whether any of the threads or fibers is broken. When a broken thread or fiber is detected, a BREAK ALARM is set in step 3205 and the tension trim algorithm 3201 is stopped at step 3227A.

When no broken threads or fibers are detected in step 3203, the method determines whether the threads or fibers are moving in step 3204 of FIG. 32. When the threads or fibers are not moving, a MOTION ALARM is set in step 3209 and the tension trim algorithm 3201 is stopped at step 3227B. When the threads or fibers are moving, a measurement of the tension of the moving threads or fibers occurs in step 3211.

In step 3212 of FIG. 32, the method determines whether any of the individual thread or fibers has a tension that is outside of a predetermined range. The predetermined range is preferably defined by at least one of the mean range tension and maximum tension as disclosed in TABLE 1 to TABLE 5 above. Alternatively, any acceptable predetermined range of tensions may be used with the thread feed processing system. When an out-of-range value of tension is detected, a TENSION ALARM is set in step 3213.

In accordance with whether the out-of-range tension is above or below the predetermined range, the motor speed is decremented or incremented, respectively, in step 3214. The number of increments and decrements in the motor speed over the course of the algorithm are stored in step 3220. When an individual thread or fiber tension has a value that is out-of-range, the method determines whether the number of increment/decrement steps that is stored in step 3220 exceeds a correction threshold in step 3218.

When no out-of-range tension values are detected for the individual threads or fibers, the method determines an average value for the tension of multiple threads or fibers in step 3215 of FIG. 32. In addition, the average value for the threads or fiber tension is stored in step 3217.

In step 3218 of FIG. 32, the method determines whether the average value for the threads or fiber tension is outside of a predetermined range. The predetermined range is preferably defined by at least one of the mean range tension and maximum tension as disclosed in TABLE 1. When an average value for the thread or fiber tension has a value that is out-of-range, the method determines whether the number of increment decrement steps, previously stored in step 3220, exceeds a correction threshold in step 3223.

The correction threshold is a predetermined value that is entered in the trim tension algorithm 3201 at initialization and may be updated in real-time. The predetermined value is a maximum number of corrections that are to be allowed by the algorithm before operator intervention is suggested. The values for the predetermined value of the correction threshold may be different in terms of the number of decrements and the number of increments that are determined to exceed the threshold.

When the correction threshold has been exceeded, by either or both the number of increments or decrements, a TENSION UPDATE alarm is set in step 3225 and the tension trim algorithm 3201 is stopped at step 3227C. When the tension trim algorithm 3201 is stopped at either of steps 3227A, 3227B or 3227C, as discussed above, the operator can read the alarm status of the equipment and take the appropriate steps to intervene and correct the process.

When the average value of the thread or fiber tension is not out-of-range, the method maintains the motor speed, as indicated in step 3221 and returns to step 3203 to repeat the above discussed trim tension monitoring algorithm.

The foregoing description of the present invention provides illustration and description, but is not intended to be exhaustive or to limit the invention to the precise form disclosed. Modifications and variations are possible in light of the above teachings or may be acquired from practice of the invention. The scope of the invention is defined by the claims and their equivalents.

The foregoing figures show particular compact creel systems used to feed elastomeric threads to a manufacturing process such as a diaper or textile machine. However, it should be understood that the present invention is not limited to the configuration of the creel systems shown. Alternative unwinder systems also fall within within the scope of the present invention even if they vary from the creel systems shown in a variety of ways not limited to but at least including: (1) number of threads being fed; (2) types of packages supported; (3) positioning and use of guide and rack frame members; and (4) number and type of drive and tension control systems. In particular, the present invention is suitable for use with any creel system where it would be desirable to monitor and control the tension of elastomeric or other types of thread in order to minimize tension variations in the thread from being introduced into a manufacturing process.

In addition, though the figures illustrate a particular compact creel system that uses the OETO method for unwinding a package, it should be understood that the present invention is equally suitable for use with creel systems that do not use the OETO method. In particular, the present invention applies to all creel systems where a tension monitoring and tension adjusting system can be used to enhance efficiency and/or quality of thread processing systems using elastomeric or other types of threads.

Further, the written description of the preferred and other exemplary embodiments discusses the applicability of the present invention for providing elastomeric thread to manufacturing processing in the form of a diaper manufacturing system. In particular, the application is preferably directed at the task of supplying elastomeric thread to be used for the elastic band features present near the open end of the legs of the diaper. While the present invention is discussed in a diaper manufacturing environment, such discussions are not intended to be limiting and is included for exemplary purposes only. It will be understood by those skilled in the art after reading the description that the present invention is equally suitable for use for any other manufacturing process that utilizes an elastomeric thread.

Further, though only a few exemplary embodiments of the present invention have been described in detail in this disclosure, those skilled in the art who review this disclosure will readily appreciate that many modifications are possible in these embodiments (e.g., types of rack systems, guide systems, drive systems, and control systems; sizes, structures, shapes and proportions of the various elements and mounting arrangements; and use of materials in terms of combinations and shapes) without materially departing from the novel teachings and advantages of the present invention.

Furthermore, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed herein.

The invention claimed is:

1. A method for positioning and loading at least one new standby package on a mandrel of a creel while an active package is being unwound, wherein said mandrel is supported on a creel frame by a package support assembly including a mandrel support bar pivotally mounted on said frame comprising:

sliding a new standby package over an end of the mandrel adjacent to a side of said mandrel support bar, at least one of an active package and a standby package being adjacent to an opposite side of said mandrel support bar;

tying a leading fiber end of the new standby package to a trailing fiber end of the at least one of an active package and standby package;

pivotally and detachably mounting a package change fixture on said creel frame adjacent to said end of said mandrel and inserting a mandrel core holder and an end pivot stud of said package change fixture into the mandrel and creel frame, respectively;

releasing the package support assembly and pivoting the package support assembly away from the mandrel;

pivoting the package change fixture, the mandrel, the mandrel support bar, and packages upward at least 10° until the end of the mandrel support bar disengages a mandrel support bolt;

removing the mandrel support bar from the creel frame and from slots in the mandrel;

pivoting the package change fixture, mandrel, and packages until the package change fixture contacts and is aligned with the creel frame;

sliding the standby package onto the mandrel at least until the new standby package contacts the at least one of the active package and a standby package and further sliding the new standby package to eject an exhausted core of an old active package from the end of the mandrel;

reinserting the mandrel support bar through the slots in the mandrel and into the support bar slots of the creel frame;

pivoting the package change fixture, mandrel and packages upward at least 10°;

pushing the mandrel support bar into the creel frame until the mandrel support bar is aligned with the mandrel support bar bolt;

pivoting the package change fixture, mandrel and packages back down to a normal operating position; and removing the package change fixture by pulling outward until the pivot stud and the mandrel core holder are disengaged from the creel frame and mandrel, respectively.

2. A method for positioning and loading at least one new standby package on a mandrel of a creel while an active package is being unwound wherein said mandrel is supported on a creel frame by a package support assembly pivotally mounted on said frame comprising:

sliding a new standby package over an end of the mandrel adjacent to a side of said package support assembly, at least one of an active package and a standby package being adjacent to an opposite side of said package support assembly;

tying a tail end of a fiber of the at least one of an active package and a standby package to the lead end of a fiber of the new standby package;

detachably mounting a package change fixture to the creel frame to support the mandrel;

inserting a mandrel core holder of the package change fixture into the mandrel and locking the mandrel core holder in place to support the packages and mandrel;

releasing the package support assembly from the mandrel and pivoting the package support assembly away from the mandrel;

sliding the new standby package along the mandrel until contacting at least one of the active packages and standby package and further sliding the new standby package until an exhausted core is ejected;

reconnecting the package support assembly to support and secure the mandrel; unlocking the mandrel core holder of the package change fixture from the mandrel; and removing the package change fixture from the mandrel and creel frame.

3. The method of claim 1 or 2 further comprising the steps of monitoring and adjusting the net tension of a fiber group or the tension of a single fiber by at least one of increasing, maintaining or decreasing the tension on the fiber group or fiber.

* * * * *